US011200844B2

(12) United States Patent
Hsu et al.

(10) Patent No.: US 11,200,844 B2
(45) Date of Patent: Dec. 14, 2021

(54) METHOD AND APPARATUS FOR CONTROLLING BRIGHTNESS OF DISPLAY, AND TERMINAL DEVICE

(71) Applicant: HUAWEI TECHNOLOGIES CO., LTD., Guangdong (CN)

(72) Inventors: Ching Hsiang Hsu, Taiwan (CN); Dustin Yuk Lun Wai, Shanghai (CN); Zeyu Niu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 17/089,680

(22) Filed: Nov. 4, 2020

(65) Prior Publication Data

US 2021/0049966 A1 Feb. 18, 2021

Related U.S. Application Data

(63) Continuation of application No. PCT/CN2019/084324, filed on Apr. 25, 2019.

(30) Foreign Application Priority Data

May 9, 2018 (CN) ..... 201810438207.5

(51) Int. Cl.
*G09G 3/3258* (2016.01)

(52) U.S. Cl.
CPC ... *G09G 3/3258* (2013.01); *G09G 2320/0276* (2013.01); *G09G 2320/0626* (2013.01)

(58) Field of Classification Search
CPC ..... G09G 2320/0276; G09G 2320/0626
See application file for complete search history.

(56) References Cited

U.S. PATENT DOCUMENTS 6,043,797 A 3/2000 Clifton et al.
7,639,218 B2 12/2009 Lee et al.
(Continued)

FOREIGN PATENT DOCUMENTS

CN 102013246 A 4/2011
CN 103390395 A 11/2013
(Continued)

OTHER PUBLICATIONS

Office Action issued in Chinese Application No. 201810438207.5 dated Sep. 1, 2020, 9 pages.
(Continued)

*Primary Examiner* — Gustavo Polo
(74) *Attorney, Agent, or Firm* — Fish & Richardson P.C.

(57) ABSTRACT

Methods and apparatuses for controlling brightness of a display are disclosed in the present disclosure. One method includes: determining a first brightness value of a display at a current brightness adjustment level; determining, based on a gamma correction lookup table, a first input grayscale value corresponding to the first brightness value, wherein the gamma correction lookup table comprises a gamma correction relationship between a brightness value of the display and an initial input grayscale value of the display at a predetermined brightness adjustment levels; and controlling an output brightness value of the display based on the first input grayscale value.

20 Claims, 7 Drawing Sheets

(56) References Cited

U.S. PATENT DOCUMENTS

| | | | | |
|---|---|---|---|---|
| 2003/0071923 | A1* | 4/2003 | Eskin | H04N 9/69 348/674 |
| 2006/0238551 | A1* | 10/2006 | Dalal | G09G 3/3648 345/690 |
| 2008/0111836 | A1* | 5/2008 | Huang | G09G 3/2096 345/690 |
| 2014/0375704 | A1 | 12/2014 | Bi et al. | |
| 2015/0123955 | A1 | 5/2015 | Bi et al. | |
| 2016/0314760 | A1 | 10/2016 | Jangda et al. | |
| 2018/0075802 | A1 | 3/2018 | Liu et al. | |
| 2018/0102088 | A1 | 4/2018 | Deng | |
| 2018/0102099 | A1 | 4/2018 | Na et al. | |

FOREIGN PATENT DOCUMENTS

| | | | |
|---|---|---|---|
| CN | 105590587 | A | 5/2016 |
| CN | 105702218 | A | 6/2016 |
| CN | 105741762 | A | 7/2016 |
| CN | 105913815 | A | 8/2016 |
| CN | 105976760 | A | 9/2016 |
| CN | 106340275 | A | 1/2017 |
| CN | 106782307 | A | 5/2017 |
| CN | 107180616 | A | 9/2017 |
| CN | 107274833 | A | 10/2017 |
| CN | 107784975 | A | 3/2018 |
| TW | 200525480 | A | 8/2005 |

OTHER PUBLICATIONS

PCT International Search Report and Written Opinion issued in International Application No. PCT/CN2019/084324 dated Jul. 17, 2019, 17 pages (with English translation).

EPO Communication pursuant to Rule 164(1) EPC Supplementary European Search Report issued in European 19800575.3 dated Apr. 8, 2021, 19 pages.

Office Action issued in Chinese Application No. 201810438207.5 dated May 24, 2021, 18 pages (with English translation).

* cited by examiner

METHOD AND APPARATUS FOR CONTROLLING BRIGHTNESS OF DISPLAY, AND TERMINAL DEVICE

CROSS-REFERENCE TO RELATED APPLICATIONS

This application is a continuation of International Application No. PCT/CN2019/084324, filed on Apr. 25, 2019, which claims priority to Chinese Patent Application No. 201810438207.5, filed on May 9, 2018. The disclosures of the aforementioned applications are hereby incorporated by reference in their entireties.

TECHNICAL FIELD

This application relates to the display field, and in particular, to a method and an apparatus for controlling brightness of a display, and a terminal device.

BACKGROUND

An organic light emitting diode display device has advantages such as self-illuminating, thin, high contrast, and wide viewing angle, and is mainly developed and used in a next-generation mobile phone panel. An active-matrix organic light emitting diode (AMOLED) has become a development focus due to good pliability of the active-matrix organic light emitting diode.

Currently, when brightness of a display changes, to properly display an image based on current brightness of the display, input data for display needs to be adjusted, to enable the input data for display to adapt to the current brightness of the display. In an existing brightness control manner, a brightness adjustment range of a display is divided to include a plurality of different brightness adjustment points, and an independent correspondence is configured for each brightness adjustment point. The correspondence may represent a mapping relationship between original input data for display on the display and output data corresponding to brightness at each brightness adjustment point, and is usually stored in a form of a lookup table. A lookup table corresponding to each brightness adjustment point may be considered as an independent memory or register. When the brightness of the display is adjusted to a brightness adjustment point, corresponding input data for display can be obtained based on a lookup table corresponding to the brightness adjustment point. Finally, output data is obtained through gamma correction, so that the display displays an output.

However, in the prior art, each existing correspondence can be obtained only through an independent measurement procedure, and a plurality of memories are required to store a plurality of correspondences. This causes relatively high costs. In addition, if the current brightness of the display is not located at an existing brightness adjustment point, the corresponding input data for display needs to be obtained in a manner such as linear interpolation. Consequently, the display displays inaccurate brightness.

SUMMARY

This application provides a method and an apparatus for controlling brightness of a display, and a terminal device, to display accurate brightness during brightness adjustment, and occupy relatively few hardware resources.

According to a first aspect, this application provides a method for controlling brightness of a display, including: determining a first brightness value of the display at a current brightness adjustment level; determining, based on a preset gamma correction lookup table, a first input grayscale value corresponding to the first brightness value, where the gamma correction lookup table includes a gamma correction relationship between a brightness value of the display and an initial input grayscale value of the display at a specified brightness adjustment level; and controlling an output brightness value of the display based on the first input grayscale value.

In this way, when brightness of the display is adjusted, a correspondence between a brightness value and an input grayscale value at another brightness adjustment level can be obtained based on the gamma correction relationship between the brightness value and the input grayscale value at the specified brightness adjustment level, and gamma correction can be performed, based on the gamma correction relationship at the specified brightness adjustment level, on brightness of the display at the another brightness adjustment level, without a need to store a gamma correction relationship at the another level. This effectively reduces occupied hardware resources.

Optionally, the display includes a Mura region. If a brightness value of each pixel on the display at an initial brightness adjustment level is a second brightness value, before the determining a first brightness value of the display at a current brightness adjustment level, the method further includes: before demura is performed for the display, determining, based on the preset gamma correction lookup table, a second input grayscale value corresponding to the second brightness value; and controlling an output brightness value of each pixel on the display based on the second input grayscale value.

In this way, before the demura is performed for the display, gamma correction is performed for the display including the Mura region; and in a brightness adjustment process, gamma correction is performed for the display for which a demura operation has been performed. This can ensure uniform brightness on the display, and can enable the display to display accurate brightness in the entire brightness adjustment process. In addition, the gamma correction that is performed before the demura is performed based on the same gamma correction lookup table in the brightness adjustment process. This can implement relatively good hardware integration, reduce used storage space, and reduce hardware costs.

Optionally, the gamma correction lookup table includes any one of the following: a plurality of discrete grayscale values and a plurality of brightness values, where a quantity of the grayscale values is equal to a quantity of the brightness values, the grayscale values one-to-one correspond to the brightness values, and the quantity of the discrete grayscale values is equal to a total quantity of grayscale values of the display; or a plurality of discrete grayscale values and a plurality of brightness values, where a quantity of the grayscale values is equal to a quantity of the brightness values, the grayscale values one-to-one correspond to the brightness values, and the quantity of the discrete grayscale values is less than a total quantity of grayscale values of the display.

In this way, current hardware may be used to store and express a limited quantity of correspondences between integer grayscale values and corresponding brightness values. This can accurately represent a correspondence between an input grayscale value and a brightness value, and can reduce used hardware resources such as memory space or a processing capability.

Optionally, two-dimensional coordinate points constituted by the discrete grayscale values and brightness values that one-to-one correspond to the discrete grayscale values are all located on a gamma curve, where a horizontal coordinate of the gamma curve represents a grayscale value, and a vertical coordinate of the gamma curve represents a brightness value. In this way, each discrete grayscale value and a corresponding brightness value can satisfy the gamma curve, so that brightness is accurately displayed.

Optionally, a current brightness value of the display at the current brightness adjustment level and a previous brightness value of the display at a previous brightness adjustment level satisfy a preset condition, where the current brightness value and the previous brightness value correspond to a same input grayscale value, the preset condition is that a ratio of a difference between the current brightness value of the current brightness adjustment level and the previous brightness value of the previous brightness adjustment level to the previous brightness value satisfies the Webber law, and the difference between the brightness values is a difference between the current brightness value and the previous brightness value. In this way, when brightness of the display is adjusted, the brightness of the display can transition evenly, to adapt to human eyes.

Optionally, a maximum brightness value supported by the display at the specified brightness adjustment level is greater than a maximum brightness value supported by the display at the current brightness adjustment level. In this way, regardless of a specific brightness adjustment level to which brightness of the display is adjusted, a brightness value of each pixel at this level is included in the gamma correction relationship between the brightness value of the pixel on the display and the input grayscale value of the pixel at the specified brightness adjustment level.

Optionally, the specified brightness adjustment level is a maximum level supported when brightness of the display is adjusted.

Optionally, the determining, based on a preset gamma correction lookup table, an input grayscale value corresponding to a brightness value specifically includes: determining the initial input grayscale value corresponding to the display when the brightness value of the display is the corresponding brightness value at the current brightness adjustment level; and replacing the initial input grayscale value with the input grayscale value determined based on the gamma correction lookup table, and using the input grayscale value as the input grayscale value corresponding to the brightness value.

Optionally, correspondences between the plurality of grayscale values and the plurality of brightness values in the gamma correction lookup table satisfy a gamma correction formula, where the brightness value is used as an input of the gamma correction formula, and the grayscale value is used as an output of the gamma correction formula. The determining, based on a preset gamma correction lookup table, an input grayscale value corresponding to a brightness value specifically includes: calculating, based on the plurality of brightness values and the gamma correction formula, a plurality of grayscale values that one-to-one correspond to the plurality of brightness values. In this way, only one preset gamma correction lookup table is required to determine gamma correction lookup tables corresponding to the display at different brightness adjustment levels. This reduces used storage space, and reduces hardware costs. In addition, a group of discrete data includes correspondences between all integer grayscale values and corresponding brightness values. This implements higher precision of the determined input grayscale value, and implements higher brightness adjustment precision for the display.

Optionally, the gamma correction formula is $f=B^{1/\gamma}*(N-1)$, where f represents a grayscale value corresponding to a normalized first brightness value at the current brightness adjustment level, $\gamma$ represents a gamma value in the preset gamma correction lookup table, and N represents a total quantity of grayscale values.

Optionally, when the first brightness value at the current brightness adjustment level is not included in the gamma correction lookup table, the determining, based on a preset gamma correction lookup table, a first input grayscale value corresponding to the first brightness value includes: obtaining, from the gamma correction lookup table, a brightness value closest to the first brightness value at the current brightness adjustment level; and using a grayscale value corresponding to the brightness value closest to the first brightness value at the current brightness adjustment level as the first input grayscale value corresponding to the first brightness value.

Optionally, when the calculated grayscale value is a decimal, the method further includes: rounding the calculated grayscale value, and using a result obtained after the rounding as the first input grayscale value corresponding to the first brightness value.

Optionally, when the first brightness value at the current brightness adjustment level is not included in the gamma correction lookup table, the determining, based on a preset gamma correction lookup table, an input grayscale value corresponding to a brightness value of the display specifically includes: determining, based on the gamma correction lookup table, two brightness values directly adjacent to the first brightness value at the current brightness adjustment level; establishing a linear interpolation equation based on the two directly adjacent brightness values and grayscale values corresponding to the two brightness values; and obtaining, according to the linear interpolation equation and the first brightness value at the current brightness adjustment level, the first input grayscale value corresponding to the first brightness value.

In this way, only one preset gamma correction lookup table is required to determine gamma correction lookup tables corresponding to the display at different brightness adjustment levels. This reduces used storage space, and reduces hardware costs. In addition, the used preset gamma correction lookup table includes only a limited quantity of correspondences between input grayscale values and brightness values, and other correspondences not included in the preset gamma correction lookup table are obtained through simple linear interpolation calculation. In this way, precision of an input grayscale value is relatively high, a calculation speed is high, and processor overheads are relatively low.

Optionally, before the determining a first brightness value of a display at a current brightness adjustment level, the method further includes: receiving a brightness adjustment signal, where the brightness adjustment signal is used to indicate to adjust the brightness of the display to the current brightness adjustment level.

According to a second aspect, this application further provides an apparatus for controlling brightness of a display, including: a brightness determining module, configured to determine a first brightness value of the display at a current brightness adjustment level; a first gamma correction module, configured to determine, based on a preset gamma correction lookup table, a first input grayscale value corresponding to the first brightness value, where the gamma correction lookup table includes a gamma correction relationship between a brightness value of the display and an initial input grayscale value of the display at a specified brightness adjustment level; and a brightness adjustment module, configured to control an output brightness value of the display based on the first input grayscale value.

In this way, when brightness of the display is adjusted, a correspondence between a brightness value and an input grayscale value at another brightness adjustment level can be obtained based on the gamma correction relationship between the brightness value and the input grayscale value at the specified brightness adjustment level, and gamma correction can be performed, based on the gamma correction relationship at the specified brightness adjustment level, on brightness of the display at the another brightness adjustment level, without a need to store a gamma correction relationship at the another level. This effectively reduces occupied hardware resources.

Optionally, the display includes a Mura region. If a brightness value of each pixel on the display at an initial brightness adjustment level is a second brightness value, the apparatus further includes: a second gamma correction module, where the second gamma correction module is configured to: before demura is performed for the display, determine, based on the preset gamma correction lookup table, a second input grayscale value corresponding to the second brightness value when a brightness value of the display at an initial level is the second brightness value. The second gamma correction module is further configured to control an output brightness of each pixel on the display based on the second input grayscale value. In addition, the apparatus further includes a Mura correction module, configured to perform the demura for the display.

In this way, before the demura is performed for the display, gamma correction is performed for the display including the Mura region; and in a brightness adjustment process, gamma correction is performed for the display for which a demura operation has been performed. This can ensure uniform brightness on the display, and can enable the display to display accurate brightness in the entire brightness adjustment process. In addition, the gamma correction that is performed before the demura is performed based on the same gamma correction lookup table in the brightness adjustment process. This can implement relatively good hardware integration, reduce used storage space, and reduce hardware costs.

Optionally, the gamma correction lookup table includes any one of the following: a plurality of discrete grayscale values and a plurality of brightness values, where a quantity of the grayscale values is equal to a quantity of the brightness values, the grayscale values one-to-one correspond to the brightness values, and the quantity of the discrete grayscale values is equal to a total quantity of grayscale values of the display; or a plurality of discrete grayscale values and a plurality of brightness values, where a quantity of the grayscale values is equal to a quantity of the brightness values, the grayscale values one-to-one correspond to the brightness values, and the quantity of the discrete grayscale values is less than a total quantity of grayscale values of the display.

In this way, current hardware may be used to store and express a limited quantity of correspondences between integer grayscale values and corresponding brightness values. This can accurately represent a correspondence between an input grayscale value and a brightness value, and can reduce used hardware resources such as memory space or a processing capability.

Optionally, two-dimensional coordinate points constituted by the discrete grayscale values and brightness values that one-to-one correspond to the discrete grayscale values are all located on a gamma curve, where a horizontal coordinate of the gamma curve represents a grayscale value, and a vertical coordinate of the gamma curve represents a brightness value.

Optionally, a current brightness value of the display at the current brightness adjustment level and a previous brightness value of the display at a previous brightness adjustment level satisfy a preset condition, where the current brightness value and the previous brightness value correspond to a same input grayscale value, the preset condition is that a ratio of a difference between the current brightness value of the current brightness adjustment level and the previous brightness value of the previous brightness adjustment level to the previous brightness value satisfies the Webber law, and the difference between the brightness values is a difference between the current brightness value and the previous brightness value. In this way, when brightness of the display is adjusted, the brightness of the display can transition evenly, to adapt to human eyes.

Optionally, a maximum brightness value supported by the display at the specified brightness adjustment level is greater than a maximum brightness value supported by the display at the current brightness adjustment level. In this way, regardless of a specific brightness adjustment level to which brightness of the display is adjusted, a brightness value of each pixel at this level is included in the gamma correction relationship between the brightness value of the pixel on the display and the input grayscale value of the pixel at the specified brightness adjustment level.

Optionally, the specified brightness adjustment level is a maximum level supported when brightness of the display is adjusted.

Optionally, the first gamma module is specifically configured to: determine the initial input grayscale value corresponding to the display when the brightness value of the display is the corresponding first brightness value at the current brightness adjustment level; and replace the initial input grayscale value with the input grayscale value determined based on the gamma correction lookup table, and use the input grayscale value as the first input grayscale value corresponding to the first brightness value.

Optionally, correspondences between the plurality of grayscale values and the plurality of brightness values in the gamma correction lookup table satisfy a gamma correction formula, where the brightness value is used as an input of the gamma correction formula, and the grayscale value is used as an output of the gamma correction formula; and the control apparatus further includes a gamma correction lookup table obtaining module, specifically configured to calculate, based on the plurality of brightness values and the correction formula, a plurality of grayscale values that one-to-one correspond to the plurality of brightness values.

In this way, only one preset gamma correction lookup table is required to determine gamma correction lookup tables corresponding to the display at different brightness adjustment levels. This reduces used storage space, and reduces hardware costs. In addition, a group of discrete data includes correspondences between all integer grayscale values and corresponding brightness values. This implements higher precision of the determined input grayscale value, and implements higher brightness adjustment precision for the display.

Optionally, the gamma correction formula is $f=B^{1/\gamma}*(N-1)$, where f represents a first input grayscale value corresponding to a normalized first brightness value at the current brightness adjustment level, γ represents a gamma value in the preset gamma correction lookup table, and N represents a total quantity of grayscale values.

Optionally, when the first brightness value at the current brightness adjustment level is not included in the gamma correction lookup table, the first gamma correction module is further configured to: first obtain, from the gamma correction lookup table, a brightness value closest to the first brightness value at the current brightness adjustment level; and then use a grayscale value corresponding to the brightness value closest to the first brightness value at the current brightness adjustment level as the first input grayscale value corresponding to the first brightness value.

Optionally, when the first brightness value at the current brightness adjustment level is not included in the gamma correction lookup table, the first gamma correction module is specifically configured to: determine, based on the gamma correction lookup table, two brightness values directly adjacent to the first brightness value at the current brightness adjustment level; establish a linear interpolation equation based on the two directly adjacent brightness values and grayscale values corresponding to the two brightness values; and obtain, according to the linear interpolation equation and the first brightness value at the current brightness adjustment level, the first input grayscale value corresponding to the first brightness value.

In this way, current hardware may be used to store and express a limited quantity of correspondences between integer grayscale values and corresponding brightness values. This can accurately represent a correspondence between an input grayscale value and a brightness value, and can reduce used hardware resources such as memory space or a processing capability.

According to a third aspect, this application provides a terminal device. The terminal device includes a processor, a first gamma selector, a first gamma correction controller, and a display. The processor is configured to determine a first brightness value of the display at a current brightness adjustment level. The first gamma selector is configured to determine, based on a preset gamma correction lookup table, a first input grayscale value corresponding to the first brightness value, where the gamma correction lookup table includes a gamma correction relationship between a brightness value of the display and an initial input grayscale value of the display at a specified brightness adjustment level. The first gamma correction controller is configured to control an output brightness value of the display based on the first input grayscale value.

In this way, when brightness of the display is adjusted, a correspondence between a brightness value and an input grayscale value at another brightness adjustment level can be obtained based on the gamma correction relationship between the brightness value and the input grayscale value at the specified brightness adjustment level, and gamma correction can be performed, based on the gamma correction relationship at the specified brightness adjustment level, on brightness of the display at the another brightness adjustment level, without a need to store a gamma correction relationship at the another level. This effectively reduces occupied hardware resources.

Optionally, the display includes a Mura region. If a brightness value of each pixel on the display at an initial brightness adjustment level is a second brightness value, the terminal device further includes a second gamma selector and a second gamma correction controller. The second gamma selector is configured to: before demura is performed for the display, determine, based on the preset gamma correction lookup table, a second input grayscale value corresponding to the second brightness value. The second gamma correction controller is further configured to control an output brightness value of each pixel on the display based on the second input grayscale value.

In this way, before the demura is performed for the display, gamma correction is performed for the display including the Mura region; and in a brightness adjustment process, gamma correction is performed for the display for which a demura operation has been performed. This can ensure uniform brightness on the display, and can enable the display to display accurate brightness in the entire brightness adjustment process. In addition, the gamma correction that is performed before the demura is performed based on the same gamma correction lookup table in the brightness adjustment process. This can implement relatively good hardware integration, reduce used storage space, and reduce hardware costs.

Optionally, the terminal device further includes a memory, configured to store the preset gamma correction lookup table.

Optionally, the gamma correction controller includes a voltage generator and a brightness controller. The voltage generator is configured to generate a reference voltage based on an input grayscale value. The brightness controller is configured to control, based on the reference voltage, the display to display brightness with a brightness value corresponding to the input grayscale value.

DESCRIPTION OF EMBODIMENTS

When a display performs display, because sensitivities of human eyes to different brightness are different, or the display has a photoelectric characteristic, brightness of an image displayed by the display is usually inconsistent with original brightness of an original input image, and there is a specific deviation. In this case, an image output by the display is distorted compared with an input image. Consequently, a color displayed by the display is greatly different from a color of the input image, or the display displays an image that is excessively bright or excessively dark. For example, when the color displayed by the display changes from black to white, an input grayscale value of the display also needs to change. However, this change is not linear. Due to a physical characteristic of the display, if the input grayscale value changes linearly, an output brightness value does not change linearly. To ensure that the output brightness value does not deviate from an expected brightness value of the display, the input grayscale value of the display needs to be corrected, in other words, a gamma correction process needs to be performed for the display, so that the display displays expected brightness. Gamma correction is performed for the display, so that a variation relationship between an input grayscale value of the display and an output brightness value of the display satisfies a correspondence curve, where the curve is a gamma curve. When the input grayscale value of the display and an output brightness value of the display satisfy the gamma curve, the display can display preset brightness and a preset color.

When the gamma curve is used to correct the brightness of the display, if the overall brightness of the display changes or input and output characteristics of a pixel on the display change, overall display of the brightness of the display is affected. Therefore, the brightness of the display needs to be corrected to ensure that the display displays proper brightness.

Figure 1:
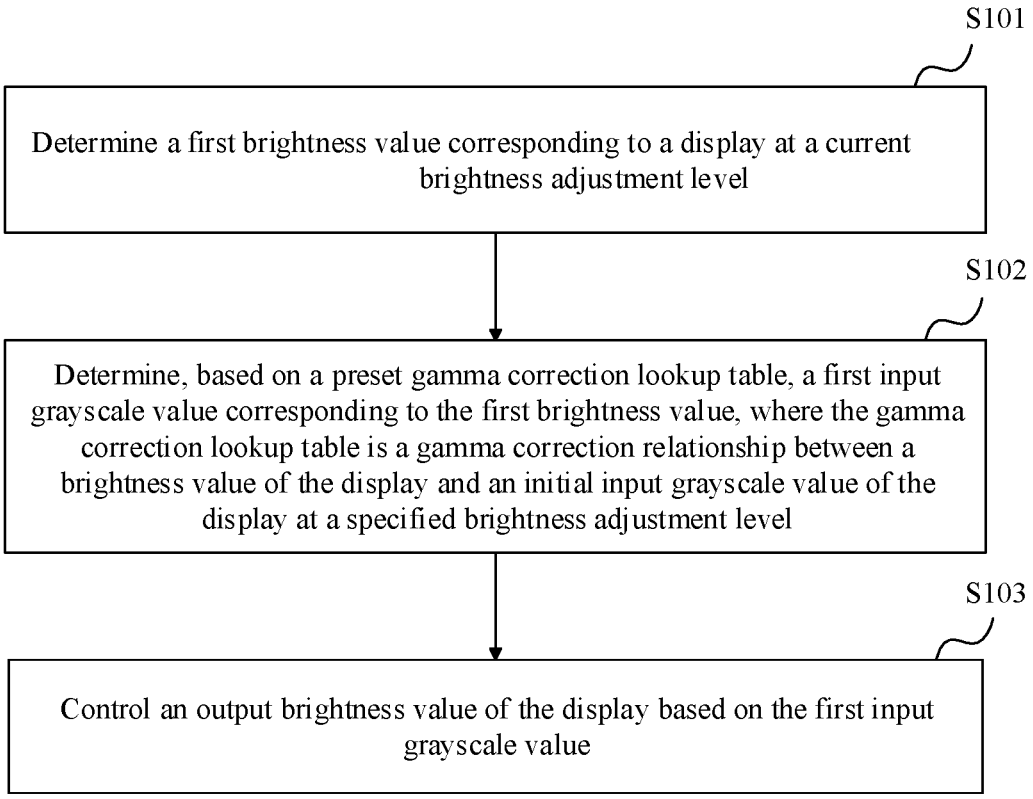
FIG. 1 is a schematic flowchart of a method for controlling brightness of a display according to an embodiment of this application.

FIG. 1 is a schematic flowchart of a method for controlling brightness of a display according to Embodiment 1 of this application. As shown in FIG. 1, the method for controlling brightness of a display provided in this embodiment may specifically include the following steps.

S101: Determine a first brightness value of the display at a current brightness adjustment level.

Specifically, to adapt to different application scenarios, optionally, the display may have a plurality of different brightness adjustment levels, and ranges of brightness that the display are different at different brightness adjustment levels. The following uses an example to describe the brightness adjustment levels of the display. A maximum brightness value of the display is 500 nits. Assuming that the display has five different brightness adjustment levels, a brightness value of the display at a first brightness adjustment level ranges from 0 to 100 nits, a brightness value of the display at a second brightness adjustment level ranges from 0 to 200 nits, . . . , and a brightness value of the display at a fifth brightness adjustment level ranges from 0 to 500 nits. Correspondingly, the five brightness adjustment levels of the display may correspond to five ticks on a brightness bar of the display. For example, the rightmost tick on the brightness bar of the display corresponds to the fifth brightness adjustment level, a tick that is left by one tick from the rightmost tick corresponds to the fourth brightness adjustment level, . . . , and the leftmost tick on the brightness bar of the display corresponds to the first brightness adjustment level (in this case, a range of brightness that can be displayed is the smallest, and the brightness of the display is the lowest). When an original image on the display presents a fixed brightness relationship at different brightness adjustment levels, brightness values corresponding to a region with a same brightness degree vary with the different brightness adjustment levels. It should be understood that the foregoing enumerated data is merely used as examples to describe the brightness adjustment levels of the display, and does not constitute a limitation on a brightness adjustment level of the display and a range of a corresponding brightness value of the display at the brightness adjustment level.

An image is displayed based on a relative brightness relationship between all pixels on the display. A same illuminance ratio is still maintained between the pixels on the display based on a same displayed image at the different brightness adjustment levels of the display, so that the entire displayed image can retain original image features such as a texture and a pattern when the brightness adjustment level changes. Specifically, when a brightness adjustment level of the display is changed, a brightness value of each pixel at the brightness adjustment level also varies with the level. In an optional case, there is a positive correlation between a brightness adjustment level of the display and a brightness value of each pixel. This can implement overall brightness adjustment of an image without damaging details such as a pattern and a texture of the image. Therefore, when the brightness adjustment level is adjusted to the current brightness adjustment level, a first brightness value of each pixel on the display at the current brightness adjustment level can be determined.

Because all the pixels on the display are independent of each other, brightness values of all the pixels are also independent of each other, and vary only with a brightness adjustment level of the display. When the display is at a brightness adjustment level, for example, at the current brightness adjustment level, all the pixels on the display each have an independent first brightness value. When the display displays a different image, brightness values of all the pixels may be the same or different. Specifically, when the display displays a same image, if the brightness adjustment level of the display is adjusted, a brightness value corresponding to a maximum input grayscale value of the display may be first determined, and a brightness value, obtained through adjustment, corresponding to another grayscale value of each pixel is determined based on a specific ratio or another positive correlation relationship. It is easily understood that the first brightness value of each pixel may have a positive correlation relationship with the brightness adjustment level of the display. In other words, the first brightness value changes in a same change direction as the brightness adjustment level of the display. When the brightness adjustment level of the display is changed from a level indicating a dark image to a level indicating a bright image, the first brightness value of each pixel increases accordingly. When the brightness adjustment level of the display is changed from a level indicating a bright image to a level indicating a dark image, the first brightness value of each pixel decreases accordingly.

S102: Determine, based on a preset gamma correction lookup table, a first input grayscale value corresponding to the first brightness value, where the gamma correction lookup table includes a gamma correction relationship between a brightness value of the display and an initial input grayscale value of the display at a specified brightness adjustment level.

Specifically, when the display performs display, and specific grayscale values are input for all the pixels, specific brightness values are correspondingly controlled in a manner such as by applying different drive voltages, so that the display properly displays an image. When the display performs display, an image output by the display is distorted compared with an input image due to sensitivities of human eyes or a photoelectric characteristic of the display. For example, a color displayed by the display is greatly different from a color of the input image, or brightness of the display is different from original brightness of the input image. To avoid a deviation between a brightness value of the display and a brightness value of the original image, an input grayscale value of the display needs to be corrected. Optionally, the input grayscale value of the display may be changed by changing a voltage input to the display. Optionally, the voltage input to the display may be corrected, so that the brightness value of the image displayed by the display is equal to or in a linear relationship with the brightness value of the image that is actually input.

In an optional case, to avoid the distortion, gamma correction may be performed on a relationship between the output brightness value of the display and the input grayscale value of the display, to adjust a response curve between an input and an output of the display, to correct a brightness deviation of the image actually displayed by the display.

When the display is at a brightness adjustment level, gamma correction relationships between brightness values of all the pixels on the display and input grayscale values of all the pixels may be continuous or discrete. For example, when the display is at a brightness adjustment level, correspondences between brightness values of all the pixels and input grayscale values of all the pixels satisfy a same response curve, namely, a gamma curve. In this case, the gamma curve may be used to represent correspondences between brightness values of all the pixels and input grayscale values of all the pixels at the level, to form gamma correction relationships between the brightness values and the input grayscale values. For example, a horizontal coordinate of the gamma curve may represent an input grayscale value, and a vertical coordinate of the gamma curve may represent a brightness value. In this case, regardless of specific brightness of each pixel, an input grayscale value corresponding to the brightness can be found on the gamma curve. In this way, both the brightness values of all the pixels and the corresponding input grayscale values of all the pixels are continuous. When an input grayscale value corresponding to a brightness value of a pixel needs to be obtained based on the brightness value, a corresponding accurate input grayscale value can be found.

The display is limited by hardware factors such as storage space and panel precision, and therefore, input grayscale values of a display panel are usually discrete positive integers. In this case, correspondences between the brightness values of all the pixels on the display and the input grayscale values of all the pixels usually do not form a continuous curve, but are some discrete points on the gamma curve. Therefore, correspondences between brightness values of all the pixels and input grayscale values of all the pixels at a brightness adjustment level may be represented by using a group of discrete data. Each brightness value and an input grayscale value corresponding to the brightness value may be represented as a discrete point on the gamma curve. In other words, two-dimensional coordinate points constituted by discrete grayscale values and brightness values that one-to-one correspond to the grayscale values are all located on the gamma curve. Herein, for example, the horizontal coordinate of the gamma curve may still represent a grayscale value, and the vertical coordinate of the gamma curve may still represent a brightness value. A quantity of points in the group of discrete data may be a total quantity of grayscale values that can be input for the display. For example, when an 8-bit grayscale value is input for the display, the grayscale value that can be input for the display is any integer ranging from 0 to 255, namely, in a total of 256 integers. In this case, 256 groups of discrete data may be stored in a preset correspondence table, and correspond to 256 discrete points on the gamma curve. When a 10-bit grayscale value is input for the display, the grayscale value that can be input for the display is any integer ranging from 0 to 1023, namely, in a total of 1024 integers. In this case, 1024 groups of discrete data may be stored in a preset gamma correction relationship table, and correspond to 1024 discrete points on the gamma curve. For example, a data format in the preset gamma correction relationship table may be (Code0, Lum). Code0 represents an input grayscale value of a pixel, and corresponds to the horizontal coordinate of the gamma curve; and Lum represents a brightness value corresponding to the input grayscale value Code0 of the pixel, and corresponds to the vertical coordinate of the gamma curve. In this way, an input grayscale value can be obtained from the gamma correction relationship table based on a corresponding known brightness value, or a brightness value can be obtained from the gamma correction relationship table based on a corresponding known grayscale value. In addition, when an input grayscale value of a pixel on the display is a discrete integer value, a quantity of grayscale values is equal to a limited value. Therefore, there are also a limited quantity of correspondences between brightness values and input grayscale values at a brightness adjustment level, for example, 256 correspondences (corresponding to an 8-bit form) or 1024 correspondences (corresponding to a 10-bit form). In this way, current hardware may be used to store and express the limited quantity of correspondences between the integer grayscale values and the corresponding brightness values. This can accurately represent a correspondence between an input grayscale value and a brightness value, and can reduce used hardware resources such as memory space or a processing capability.

In an optional case, the preset gamma correction relationship table includes only some of all the grayscale values that can be input for the display and brightness values corresponding to the some grayscale values. For example, for an 8-bit display, the preset gamma correction relationship table may include only 30 gamma correction relationships between input grayscale values and brightness values. A gamma correction relationship that is between a grayscale value and a corresponding brightness value and that is other than the 30 gamma correction relationships between the input grayscale values and the brightness values may be obtained through calculation based on the existing gamma correction relationships between the brightness values and the grayscale values in the group of data. Specifically, a remaining gamma correction relationship may be obtained in a manner such as interpolation calculation. Compared with a manner in which the discrete data includes all gamma correction relationships, this manner further reduce required hardware resources because there are few gamma correction relationships. In addition, a result close to an actual correspondence can be obtained in the manner such as interpolation calculation, and relatively accurate correction can be implemented.

When gamma correction is performed, and the display is at a brightness adjustment level, correct gamma correction relationships between the input grayscale values of all the pixels on the display and the output brightness values of all the pixels may usually be obtained in a plurality of manners.

In an optional case, to perform gamma correction for the display, the gamma correction lookup table may be used to determine the gamma correction relationship between the output brightness of the display and the input grayscale value of the display. The gamma correction lookup table usually includes the initial input grayscale value of the display and the corresponding brightness value of the display. Actually, the gamma correction lookup table is a mapping table between the initial input grayscale value of the display and the corresponding brightness value of the display. The gamma correction lookup table may be used to obtain an input grayscale value corresponding to a specific brightness value of the display, or obtain an output brightness value corresponding to a specific grayscale value. The gamma correction lookup table may be usually obtained in a manner of on-site measurement on a production line. Specifically, at a measurement position on the production line, an external device such as an image generator may be used to input a preset input grayscale value for a display, and a sampling device may be used to sample and measure a corresponding brightness value of the display. In this way, different input grayscale values and corresponding brightness values are obtained through measurement, one-to-one correspondences between the input grayscale values and the brightness values are established one by one, and the obtained correspondences are written into a register or a memory and arranged in a form of a list in a specific sequence. In this way, the gamma correction lookup table is obtained. During the gamma correction, a desired input grayscale value or brightness value can be obtained from the gamma correction lookup table.

Specifically, input grayscale values of the display have different grayscale levels. For example, an input grayscale value may be any value ranging from 0 to 255. For example, each different input grayscale corresponds to one output brightness value. In this case, the gamma correction lookup table may store relationships between all input grayscale values of the display and corresponding output brightness values of the display. In an optional case, based on different display characteristics of the display, a grayscale value of the display may have different bits, for example, 8 bits or 10 bits. When an 8-bit grayscale value is input for the display, a pixel on the display may correspond to $2^8=256$ different grayscale values. To be specific, an input grayscale value of the pixel may be any integer ranging from 0 to 255. Optionally, when a 10-bit grayscale value is input for the display, a pixel on the display may correspond to $2^{10}=1024$ grayscale values, and correspondingly, an input grayscale value of the pixel may be any integer ranging from 0 to 1023. Correspondingly, the gamma correction lookup table may store gamma correction relationships between different input grayscale values and different output brightness values, so that input grayscale values corresponding to a pixel are found based on different output brightness values, and a parameter such as a voltage corresponding to the pixel is further adjusted.

Optionally, due to a limitation on storage space of hardware, the gamma correction lookup table usually includes only a gamma correction relationship between an initial input grayscale value of the display and a brightness value of the display at one brightness adjustment level. For example, the gamma correction lookup table may be the gamma correction relationship between the brightness value of the display and the initial input grayscale value of the display at the specified brightness adjustment level.

The brightness adjustment level mainly means that a specific correspondence exists between the initial input grayscale value of the display and a pre-specified brightness value of the display when the display is at the level, so that the entire display maintains a brightness level range. When the brightness adjustment level is changed, there is a different brightness value at a new brightness adjustment level based on a same initial input grayscale value corresponding to a pixel. This can enable the display to display a same image in different brightness statuses. In an optional case, the gamma correction lookup table may include two groups of data, and each piece of data in a first group of data corresponds to one piece of data in a second group of data. Assuming that the first group of data is an input grayscale value of the display and the second group of data is a corresponding brightness value, a brightness value can be found from the gamma correction lookup table based on a corresponding input grayscale value, or an input grayscale value can be found from the gamma correction lookup table based on a corresponding brightness value.

In an optional case, when the display displays a uniform pure-color image, all the pixels on the display have a same brightness value, in other words, all the pixels display same brightness. Correspondingly, all the pixels have a same initial input grayscale value. It should be understood that the uniform pure-color image is an image whose pixels all have a same pixel value. However, in an optional case, when the display displays a non-uniform image, different pixels on the display usually have different input grayscale values, to present bright and dark textures of the image. In this case, the different grayscale values also correspond to different brightness values. In other words, the different pixels on the display have different brightness. It should be understood that the non-uniform image is an image with at least one color. Optionally, the non-uniform image may have relatively rich texture features.

The following describes a general process of determining, based on the preset gamma correction lookup table, the input grayscale value corresponding to the brightness value of the display at the specified brightness adjustment level by using an example in which the display displays a uniform pure-color image, for example, a uniform pure-white image. For example, it is assumed that a current brightness value of the display is a brightness value corresponding to a maximum grayscale value that can be input for the display. In this case, because the display displays uniform brightness, input grayscale values corresponding to all the pixels on the display are the same, brightness values of all the pixels on the display are also equal to the brightness value corresponding to the maximum grayscale value, and a brightness bar used for brightness adjustment on the display is adjusted to a maximum tick (for example, to the rightmost tick on the brightness bar). An input grayscale value corresponding to the brightness value is determined for each pixel based on the gamma correction lookup table, and the found grayscale value is used as an actual input grayscale value of the pixel on the display, where the actual input grayscale value is a grayscale value that each pixel on the display should have for displaying the brightness value of the pixel at the specified brightness adjustment level, so that actual brightness of the display does not deviate from desired brightness. For example, in this embodiment of this application, because the display displays the uniform pure-color image, brightness values of all the pixels on the display are equal in an ideal case. Initial input grayscale values corresponding to output brightness values in the ideal case are determined based on the gamma correction lookup table, and the grayscale values are used as inputs for all the pixels, so that actual brightness values of the display are equal to the brightness values in the ideal case. In an optional case, the input grayscale values of all the pixels may be adjusted by changing a value of a voltage used to drive all the pixels on the display to emit light. For example, the input grayscale values of all the pixels may be increased or decreased by increasing or decreasing a voltage input to the display.

In this way, after the gamma correction, a phenomenon that the image displayed by the display is excessively dark or excessively bright or has non-uniform brightness can be avoided.

In an optional case, when the display displays the non-uniform image, and brightness of all the pixels on the display is different, the input grayscale values corresponding to the brightness are also different. In this case, brightness that each pixel on the display expects to display is determined, a grayscale value corresponding to the brightness that each pixel expects to display is correspondingly found from the gamma correction lookup table, and the found input grayscale value is used as an actual input grayscale value of the display. Optionally, a voltage for driving each pixel on the display is controlled, so that the input grayscale value of the display is the grayscale value found from the gamma correction lookup table. After the gamma correction is performed for the display, the brightness value of each pixel on the display is the same as a brightness value of the input image. In this way, brightness deviation does not occur. For example, a phenomenon that the displayed image is excessively dark or excessively bright or has non-uniform brightness does not occur.

When the brightness adjustment level of the display is changed, a current brightness value of the display at the current brightness adjustment level and a previous brightness value of the display at a previous brightness adjustment level usually need to satisfy a specific preset condition. The current brightness value and the previous brightness value correspond to a same input grayscale value. In this way, when the display is adjusted from the brightness value at the previously specified brightness adjustment level to the brightness value at the current brightness adjustment level, visual discomfort caused to human eyes due to an obvious change in brightness of the display can be avoided.

Specifically, when the brightness of the display is adjusted, the brightness of the display can transition evenly. In an optional manner, a ratio of a difference between the current brightness value of the current brightness adjustment level and the previous brightness value of the previous brightness adjustment level to the previous brightness value satisfies the Webber law (Web-Fechner Law), and the difference between the brightness values is a difference between the current brightness value and the previous brightness value.

Specifically, when the brightness is adjusted, the brightness of the display may change within a specific brightness adjustment range. Due to a hardware limitation and the like, the brightness of the display is not adjusted smoothly. Instead, the brightness adjustment range is divided to include several brightness adjustment points at equal intervals. Each brightness adjustment point corresponds to one independent brightness value. Different brightness adjustment points are sequentially traversed during the adjustment of the brightness of the display, and corresponding brightness of the display is sequentially displayed as brightness values at the different brightness adjustment points. It may be understood that, when the brightness adjustment level of the display is adjusted from the previous brightness adjustment level, namely, a level before the brightness adjustment, to the current brightness adjustment level, the brightness values of the display that correspond to a same input grayscale value at the two different levels, that is, the current brightness value at the current brightness adjustment level and the previous brightness value at the previous level, may be brightness values at two adjacent brightness adjustment points. In this case, if the difference between the brightness values of the display at the two different brightness adjustment levels is excessively large, when the display is adjusted between the two adjacent brightness adjustment points, a difference between the brightness values at the two adjacent brightness adjustment points is quite large. Consequently, the brightness of the display presents a jump effect, and visual experience of a user is severely affected. According to the Webber law, a threshold of a difference perceived by human eyes varies with a stimulus. Therefore, to prevent a phenomenon such as flickering from occurring on the display during the brightness adjustment, a brightness change amount between the two adjacent brightness adjustment points needs to be reduced to a degree at which human eyes do not perceive a dramatic change. In other words, the ratio of the difference between the brightness values, that is, the difference between the current brightness value and the previous brightness value, to the previous brightness value of the display at the previous brightness adjustment level is less than a specific threshold. In this case, the difference between the brightness values of the display at the two different brightness adjustment levels varies with the brightness value, corresponding to the same grayscale value, at the level before the brightness adjustment. A larger brightness value of the display indicates higher brightness of the display. In this case, even if a brightness change is relatively large, human eyes are not likely to perceive the change. However, a smaller brightness value of the display indicates lower brightness of the display. In this case, human eyes are more sensitive to a brightness change, and therefore, a relatively small difference between brightness values needs to be maintained. Generally, the current brightness value and the previous brightness value are respectively maximum brightness of the display at the current brightness adjustment level and the previous brightness adjustment level.

Specifically, according to experience data, the threshold may be 0.017. To be specific, when the brightness of the display is adjusted, the ratio of the difference between the brightness values at the two adjacent brightness adjustment points to the previous brightness value of the display at the previous brightness adjustment level is less than or equal to 0.017. This can implement a relatively smooth brightness adjustment process when the brightness of the display is adjusted, and human eyes are not likely to perceive a jump with a unit brightness change amount. For example, when a maximum brightness value at the level before the brightness adjustment is L, the ratio of the difference □L between the brightness values to L (□L/L) is less than or equal to 0.017, and a brightness value L' (L'=L−□L) after the change is greater than or equal to 0.983.

It may be understood that, when the brightness of the display is adjusted, several brightness adjustment points may need to be traversed before the display can be adjusted to an expected brightness value. In this case, a difference between brightness values at every two adjacent brightness adjustment points should be less than or equal to 0.017 times a brightness value corresponding to a same preset grayscale value at a level before brightness adjustment, that is, $L_N-L_{N-1}\leq 0.017*L_N$. In this way, a brightness change between every two brightness adjustment points reaches a degree at which human eyes are not likely to perceive a dramatic change, and human eyes are not likely to perceive a dramatic change in the brightness of the display in the entire process of adjusting the brightness of the display from initial brightness to the expected brightness. This ensures visual experience of a user.

However, when the brightness adjustment level of the display is changed, brightness of each pixel on the display changes correspondingly. In an optional case, the maximum brightness value of the display at the current brightness adjustment level is 0.983 times the maximum brightness value at the level before the brightness adjustment. Correspondingly, other brightness values of the display are also 0.983 times the brightness value at the level before the brightness adjustment.

When the brightness adjustment level of the display is changed to any brightness adjustment level, a gamma correction relationship or a gamma correction lookup table at a specified brightness adjustment level may be used to determine a grayscale value corresponding to brightness of any pixel on the display at the current brightness adjustment level. Specifically, a maximum brightness value supported by the display at the specified brightness adjustment level may be greater than the maximum brightness value of the display at the current brightness adjustment level. In addition, optionally, the specified brightness adjustment level may be a maximum level supported when the brightness is adjusted. In this case, because the maximum brightness value supported by the display at the specified brightness adjustment level reflects a maximum brightness value that can be reached by the display, regardless of a specific brightness adjustment level to which the brightness of the display is adjusted, a brightness value of each pixel at this level is included in the gamma correction relationship between the brightness value of the pixel on the display and the input grayscale value of the pixel at the specified brightness adjustment level.

Figure 2:
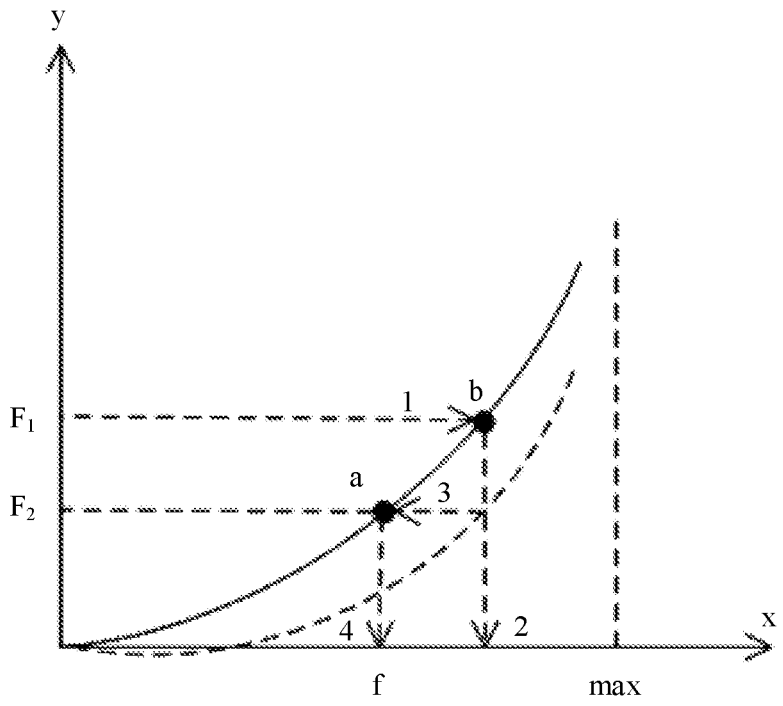
FIG. 2 is a schematic diagram of gamma curves at different brightness adjustment levels.

However, when the brightness of the display is adjusted to the current brightness adjustment level, same display hardware is used for display before and after the brightness adjustment. Due to inconsistent sensitivities of human eyes to different brightness or the photoelectric characteristic of the display, non-linear changes presented by brightness of the image displayed by the display and brightness of the original image (namely, the grayscale value of each pixel) should still satisfy a gamma curve, to ensure that the image has proper brightness and a proper color. It should be understood that a gamma curve after the brightness adjustment level is changed is not the same as a gamma curve before the brightness adjustment. For example, as shown in FIG. 2, a solid curve is the gamma curve before the brightness adjustment level is changed, and a dashed-line curve is the gamma curve after the brightness adjustment level is changed. It can be learned from FIG. 2 that a same input grayscale value (corresponding to a same x coordinate) of a pixel corresponds to different brightness values (corresponding to different y coordinates) on different gamma curves. However, theoretically, when the same grayscale value is input, the same display hardware may display only same brightness. In this case, a gamma correction relationship between an input grayscale value of each pixel on the display and a brightness value of each pixel needs to be corrected, so that gamma correction relationships between input grayscale values and brightness values at different brightness adjustment levels all satisfy gamma curves. In other words, the same initial grayscale value input for all the pixels on the display correspond to different brightness values at the different brightness adjustment levels. For example, it is assumed that an input grayscale value of a pixel is 1023 and a brightness value of the pixel at a previous brightness adjustment level is 500 nits (corresponding to a y coordinate 500 on the solid curve). After the brightness adjustment level of the display is changed, if an input grayscale value is also 1023 at a brightness adjustment level after the adjustment, a brightness value needs to be adjusted accordingly, so that the input grayscale value and a brightness value at a level after the adjustment can also satisfy a gamma curve (corresponding to the dashed-line curve in FIG. 2). In an optional case, the brightness value after the adjustment is 0.983 times the previous brightness value. In this case, when the input grayscale value is 1023, the brightness value is 491.5 nits (corresponding to a y coordinate 491.5 on the dashed-line curve).

It should be understood that the foregoing lists only gamma curves at two different brightness adjustment levels. Correspondingly, FIG. 2 also shows only the gamma curves at the two different brightness adjustment levels. In an actual case, each brightness adjustment level of the display corresponds to a different gamma curve. To ensure that the gamma correction relationships between the input grayscale values of all the pixels on the display and the brightness values of all the pixels all satisfy gamma curves at the different brightness adjustment levels, theoretically, measurement needs to be performed for the display at each brightness adjustment level to obtain a gamma curve corresponding to the level, and the gamma curve is stored in a register or a memory. However, this operation occupies a plurality of production lines for performing measurement, occupies measurement resources, occupies a large amount of storage space, and increases hardware costs. In this embodiment of this application, a gamma curve corresponding to input grayscale values of all the pixels on the display and brightness values of all the pixels at only one specified brightness adjustment level may be measured, and a gamma curve corresponding to input grayscale values and brightness values at another brightness adjustment level is calculated based on the gamma curve. This reduces resources used for measurement on the production lines, and reduces hardware resources used for storage. In an optional case, a level corresponding to a maximum brightness value of the display may be selected as the specified brightness adjustment level, and a gamma correction relationship between an input grayscale value of the display and a brightness value of the display is obtained through measurement at the brightness adjustment level, to obtain a gamma curve. The gamma curve includes all brightness values from a minimum brightness value to the maximum brightness value of the display. After the level is adjusted, a brightness value of the display is less than the brightness value at the specified brightness adjustment level. Therefore, the brightness value of the display and a corresponding input grayscale value of the display can still be found on the gamma curve. The gamma curve corresponding to the maximum brightness value at the brightness adjustment level may be pre-stored in a memory or a register; and after the brightness adjustment level is changed, a gamma curve corresponding to an input grayscale value and a brightness value at another brightness adjustment level is calculated based on the pre-stored gamma curve. In this way, a correspondence between the input grayscale value and the brightness value at the another level is corrected.

When the display is at a brightness adjustment level, correspondences between brightness values of all the pixels on the display and input grayscale values of all the pixels may be continuous or discrete. Therefore, when the display is at a brightness adjustment level, correspondences between brightness values of all the pixels and input grayscale values of all the pixels may satisfy a same curve, that is, the foregoing gamma curve. In this case, the gamma curve may be used to represent gamma correction relationships between brightness values of all the pixels and input grayscale values of all the pixels at the brightness adjustment level. In this case, regardless of specific brightness of each pixel, an input grayscale value corresponding to the brightness can be found on the gamma curve.

In addition, when the gamma correction relationships between the brightness values of all the pixels on the display and the input grayscale values of all the pixels cannot be expressed by a continuous curve due to a limitation on hardware and the like, discrete data may be used to represent a gamma correction lookup table between the brightness values of all the pixels and the input grayscale values of all the pixels at a brightness adjustment level. Each brightness value and an input grayscale value corresponding to the brightness value may be represented as a discrete point on the gamma curve. Specifically, the gamma correction lookup table may include a plurality of discrete grayscale values and a plurality of brightness values, where a quantity of the grayscale values is equal to a quantity of the brightness values, the grayscale values one-to-one correspond to the brightness values, and the quantity of the discrete grayscale values is equal to a total quantity of grayscale values of the display. In this way, an input grayscale value can be obtained from the gamma correction lookup table based on a corresponding known brightness value, or a brightness value can be obtained from the gamma correction lookup table based on a corresponding known grayscale value. When a brightness value is not included in a correspondence represented by the group of discrete data, an input grayscale value corresponding to the brightness value may be obtained in a manner such as interpolation calculation based on an existing brightness value and grayscale value.

In addition, a group of discrete data is also used to express the gamma correction relationships between the brightness values of all the pixels on the display and the input grayscale values of all the pixels in the gamma correction lookup table. However, the group of discrete data includes only some correspondences in all correspondences. Remaining unknown correspondences in all the correspondences may be obtained based on the correspondences between the brightness values and the grayscale values that are included in the group of data. Specifically, the gamma correction lookup table also includes a plurality of discrete grayscale values and a plurality of brightness values, a quantity of the grayscale values is equal to a quantity of the brightness values, the grayscale values one-to-one correspond to the brightness values, and the quantity of the discrete grayscale values is less than a total quantity of grayscale values of the display. In this case, the remaining correspondences may be obtained in a manner such as interpolation calculation. In this case, some gamma correction relationships included in the group of discrete data are usually represented as discrete points distributed at equal intervals on the gamma curve.

For ease of explanation, FIG. 2 is still used as an example for description. The solid curve represents the gamma curve that is obtained at the specified brightness adjustment level based on the input grayscale value and the brightness value that is measured on the production line. In an optional case, a maximum brightness value of the display is 500 nits. In this case, a brightness adjustment level corresponding to 500 nits is selected as the specified brightness adjustment level. Because the maximum brightness value of the display corresponds to a maximum input grayscale value, for example, the grayscale value is 1023, a gamma curve at the specified brightness adjustment level indicates a gamma correction relationship between the grayscale value 1023 and the brightness value 500 nits. After the brightness adjustment level is adjusted, a maximum brightness value of the display is changed to 491.5 nits. In this case, a gamma correction relationship between an initial input grayscale value and a brightness value should satisfy the gamma curve shown as the dashed-line curve in FIG. 2. However, the gamma curve shown as the dashed-line curve does not exist actually (the gamma curve is neither actually obtained through measurement nor stored in a memory or a register). In this case, it can be learned through observation that a corresponding input grayscale value can be found, on the gamma curve represented by the solid curve, for the brightness value 491.5 nits that is obtained after the brightness adjustment level is adjusted. In this way, a specific grayscale value that needs to be input can be found on the solid curve for the brightness value 491.5 nits. On the solid curve in FIG. 2, an input grayscale value corresponding to the brightness value 491.5 nits should be 1015. The found value 1015 is used as an actual input grayscale value of a pixel whose initial input grayscale value is 1023. In other words, 1023 is replaced with 1015, so that the brightness value at the level after the adjustment is 491.5 nits.

It can be understood that the gamma curve after the brightness adjustment level is changed is neither obtained through actual measurement nor stored in a memory, but is obtained through a series of calculations. Optionally, during actual use, only a limited quantity of gamma correction relationships between input grayscale values and brightness values need to be calculated. In this case, correspondences between the input grayscale values and the brightness values are represented as some discrete points on the gamma curve.

It should be understood that, after the brightness adjustment level is changed, when the initial input grayscale value is 1023, the brightness value is not 491.5 nits. For example, an original input image source is a picture of a panda, and an input grayscale value corresponding to a region in which white hair of the panda is located is 1023. Before the brightness adjustment level is changed, a brightness value in the white hair region corresponding to the initial grayscale value 1023 is 500 nits. After the brightness adjustment level is changed, a brightness value in the white hair region corresponding to the initial grayscale value 1023 should be changed to 491.5 nits. If correction is not performed, brightness corresponding to 491.5 nits cannot be actually displayed in the white hair region corresponding to the initial input grayscale value 1023. However, it may be obtained, based on the gamma curve corresponding to the solid curve, that a grayscale value that needs to be input for outputting 491.5 nits is 1015. In this case, 1015 is used as a grayscale value corresponding to the white hair region in the image source, to be actually input for the pixel on the display. In this way, the brightness value corresponding to the grayscale value 1023 in the image source is 491.5 nits in the region. 1023 is the initial input grayscale value corresponding to the white hair region in the image source, and 1015 is the actual input grayscale value corresponding to the white hair region. In an optional case, it is assumed that an initial input grayscale value is Code0, and an actual input grayscale value is Code1. In this case, a function f(.) may be used to represent a correspondence between the initial grayscale value of the image source and the actual input grayscale value, that is, Code1=f(Code0). Further, a function G(.) may be used to represent a correspondence between the actual input grayscale value Code1 and a brightness value. Assuming that the brightness value is Lum, Lum=G(Code1). It should be understood that a horizontal coordinate of the gamma curve shown in FIG. 2 represents the initial input grayscale value Code0 of the image source, a vertical coordinate of the gamma curve represents the brightness value Lum, and a composite function may be used to represent a correspondence between the initial input grayscale value and the brightness value, that is, Lum=G(Code1)=G(f(Code0)). After the brightness adjustment level is changed, it is first determined that the initial input grayscale value Code0 corresponds to the brightness value Lum, and then a grayscale value Code1 that should be input and that corresponds to the brightness value Lum before the level is changed may be obtained based on the pre-stored gamma curve (for ease of understanding, a brightness adjustment level at which the gamma curve is obtained through measurement is used as the brightness adjustment level before the change). Code1 is used as a grayscale value, namely, a first input grayscale value, that corresponds to Code0 and that is actually input for a pixel, so that a brightness value of the pixel may be Lum, namely, a first brightness value corresponding to the first input grayscale value.

In this way, it can be determined that, after the brightness adjustment level of the display is changed, when the pixel displays brightness with the first brightness value at the current brightness adjustment level, the first grayscale value that is input and that corresponds to the first brightness value should be a grayscale value, that is, Code1, that should actually be input for the pixel. Different input grayscale values correspond to different drive voltages, and the display also displays different brightness. Correspondingly, a voltage used to drive the pixel is not a voltage value corresponding to Code0, but a voltage value corresponding to Code1.

For example, assuming that the display is a 10-bit display and always displays a uniform white image, brightness values of all the pixels on the display are the same and are all equal to the maximum brightness value of the display at the specified brightness adjustment level. In other words, the brightness values of all the pixels are all 500 nits, and corresponding input grayscale values are all equal to the maximum grayscale value 1023. When the brightness of the display is adjusted, a difference between the brightness values of the display when the brightness of the display is changed from the specified brightness adjustment level to the current brightness adjustment level may be a fixed value. For example, the fixed value may be 0.017 times the maximum brightness value before the brightness adjustment level is changed, that is, $\Delta L=L*0.017$. Correspondingly, the brightness adjustment point on the brightness bar on the display also moves by one tick.

When the brightness adjustment level of the display is changed to the current brightness adjustment level, maximum brightness of the display may be adjusted to $500*(1-0.017)=491.5$ nits. To be specific, when the brightness adjustment point on the brightness bar moves by one tick, the maximum brightness value of the display is changed from 500 nits to 491.5 nits. In this case, the initial input grayscale value Code0 of the display remains unchanged, but the actual corresponding input grayscale value Code1 needs to be changed to another grayscale value, to display brightness with a brightness value corresponding to the another grayscale value.

Specifically, because the gamma correction relationship between the initial input grayscale value of the display and the brightness value of the display at the specified brightness adjustment level has been pre-stored in a memory or a register, the gamma correction relationship may be included in a gamma correction lookup table. Optionally, the gamma correction lookup table may include a continuous gamma curve, or may be represented as some discrete points on the gamma curve. Therefore, when the display is at the current brightness adjustment level, to find an actual input grayscale value that each pixel should have for displaying a corresponding brightness value at the current brightness adjustment level, the preset gamma correction lookup table may alternatively be used to obtain a first input grayscale value that each pixel on the display should have for displaying a first brightness value at the current brightness adjustment level.

S103: Control an output brightness value of the display based on the first input grayscale value.

After the grayscale value that should be actually input for each pixel on the display is re-determined to correctly display the image, the grayscale value may be used as the actual input grayscale value, namely, the first input grayscale value, that each pixel on the display should have for displaying the corresponding first brightness value at the current brightness adjustment level. During the display, an initial grayscale value of each pixel of the source image is replaced with the actual grayscale value. After processing is performed based on the preset gamma correction lookup table, an output of the display at the current brightness adjustment level may be obtained.

After the foregoing steps are performed, when the brightness adjustment level of the display is changed, for example, adjusted from the specified brightness adjustment level to the current brightness adjustment level, each pixel on the display may display new brightness based on a change in overall brightness of the display, so that the display properly displays the image based on new overall brightness. To enable each pixel to display the new brightness, an input grayscale value that the pixel should have for displaying the new brightness may be found based on the existing preset gamma correction lookup table, and the input grayscale value is used to replace an initial grayscale value of the display for the source image, so that overall brightness of the image can be changed while the features such as the texture and the pattern of the source image are retained. In this process, the same gamma correction lookup table is used in the entire gamma correction process. In comparison with the prior art in which a plurality of gamma correction lookup tables corresponding to different preset brightness adjustment levels of the display are pre-stored on hardware and a corresponding gamma correction lookup table is invoked for a gamma correction process when the brightness of the display is adjusted to different brightness, the method for controlling brightness of a display in this embodiment can significantly reduce occupied storage space on hardware, and further reduce manufacturing costs. In addition, in comparison with a method for obtaining, by performing interpolation based on gamma correction lookup tables corresponding to several known preset brightness values, a gamma correction lookup table corresponding to another brightness value, in the method for controlling brightness of a display in this embodiment, regardless of a specific brightness adjustment level to which the brightness of the display is adjusted, a corresponding input can be obtained through calculation based on the preset gamma correction lookup table. This implements relatively high correction precision.

In this embodiment, the method for controlling brightness of a display includes: determining a brightness value of the display at the current brightness adjustment level; determining, based on the preset gamma correction lookup table, an input grayscale value corresponding to the brightness value, where the gamma correction lookup table is the gamma correction relationship between the brightness value of the display and the initial input grayscale value of the display at the specified brightness adjustment level; and controlling brightness of the display based on the input grayscale value. In this way, a correspondence between a brightness value and an input grayscale value at another brightness adjustment level can be obtained based on the gamma correction relationship between the brightness value and the input grayscale value at the specified brightness adjustment level, and gamma correction can be performed, based on the gamma correction relationship at the specified brightness adjustment level, on brightness of the display at the another brightness adjustment level, without a need to store a gamma correction relationship at the another level. This effectively reduces occupied hardware resources.

In a process of correcting the brightness of the display, due to a limitation on hardware, a series of discrete points may usually be used to represent correspondences between brightness values of all the pixels on the display and input grayscale values of all the pixels. A 10-bit display is used as an example. There may be a total of 1024 discrete points used to represent the correspondences between the brightness values and the input grayscale values, and each discrete point corresponds to one grayscale value in grayscale values 0 to 1023 and a corresponding brightness value. In this way, the gamma correction lookup table may be used to represent the correspondences between the brightness values and the input grayscale values. To be specific, the gamma correction lookup table may include a plurality of discrete grayscale values and a plurality of brightness values, where a quantity of the grayscale values is equal to a quantity of the brightness values, the grayscale values one-to-one correspond to the brightness values, and the quantity of the discrete grayscale values is equal to a total quantity of grayscale values of the display. When step S102 in the foregoing embodiment is performed, to be specific, when the first input grayscale value corresponding to the first brightness value at the current brightness adjustment level is determined based on the preset gamma correction lookup table, the first input grayscale value corresponding to the first brightness value at the current brightness adjustment level may be obtained based on the gamma correction relationships represented by these discrete points.

In this embodiment, correspondences between the plurality of grayscale values and the plurality of brightness values in the gamma correction lookup table may satisfy a gamma correction formula, where the brightness value is used as an input of the gamma correction formula, and the grayscale value is used as an output of the gamma correction formula. In an optional implementation, the step of determining, based on a preset gamma correction lookup table, a first input grayscale value corresponding to the first brightness value at the current brightness adjustment level may specifically include the following step:

calculating, based on the plurality of brightness values and the gamma correction formula, a plurality of grayscale values that one-to-one correspond to the plurality of brightness values.

Specifically, the grayscale values and the brightness values in the gamma correction lookup table are all located on a gamma curve. In this case, a grayscale value corresponding to a brightness value can be obtained through calculation according to the gamma correction formula corresponding to the gamma curve. The gamma correction formula corresponding to the gamma curve is usually a power function. When the gamma correction formula is used for calculation, the plurality of brightness values of the display may be first obtained, and the plurality of grayscale values required for displaying the brightness values may be obtained based on the brightness values and according to the gamma correction formula.

In the foregoing steps, different displays have different brightness adjustment ranges. For example, a maximum brightness value of the display may be 500 nits or 800 nits. Before an actual input grayscale value corresponding to a brightness value of a pixel is obtained based on the brightness value, a dimension of each brightness value may usually be eliminated. For example, an absolute value relationship between the maximum brightness value of the display at the specified brightness adjustment level and the maximum brightness value of the display at the current brightness adjustment level, and an absolute value relationship between a first brightness value of a pixel at the current brightness adjustment level and a brightness value of the pixel at the specified brightness adjustment level are changed to relative value relationships, to eliminate impact caused by different dimensions. This simplifies a calculation process, and improves accuracy of a result.

Specifically, to eliminate impact caused by a dimension of a brightness value, after the brightness adjustment level of the display is adjusted from the specified brightness adjustment level to the current brightness adjustment level, normalization processing may be performed on a first brightness value corresponding to any pixel in all the pixels at the current brightness adjustment level. A normalized brightness value is a dimensionless value. The dimensionless value may be directly substituted into the gamma correction formula, to obtain a relative ratio relationship between the first brightness value of the pixel at the current brightness adjustment level and a brightness value of the pixel at the specified brightness adjustment level.

Optionally, when normalization processing is performed on the first brightness value at the current brightness adjustment level, a normalized brightness value may be specifically obtained according to Formula (1):

$$F_2=F_1*B_2/B_1 \quad (1)$$

where $F_2$ represents a normalized first brightness value at the current brightness adjustment level, $F_1$ represents a normalized brightness value at the specified brightness adjustment level, $B_2$ represents the maximum brightness value of the display at the current brightness adjustment level, and $B_1$ represents the maximum display brightness corresponding to the display at the specified brightness adjustment level.

For example, after the normalization processing, the brightness value at the specified brightness adjustment level may usually be simplified into a dimensionless number, to facilitate subsequent calculation.

For example, the display may display a pure-color image. In this case, when the display is at the specified brightness adjustment level, a brightness value of each pixel on the display may be the maximum brightness value of the display at the specified brightness adjustment level. Specifically, when both the maximum brightness value of the display at the specified brightness adjustment level and the brightness value of each pixel are 500 nits, normalization processing is performed on both the brightness values, and a corresponding normalized brightness value at the specified brightness adjustment level may be 500/500=1.

In this way, when the brightness adjustment level of the display needs to be adjusted to the current brightness adjustment level, for example, when the maximum brightness value of the display at the current brightness adjustment level may be 491.5 nits, according to Formula (1), the normalized first brightness value $F_2$ at the current brightness adjustment level may be calculated as follows: $F_2=1*491.5/500=0.983$.

Then, based on the preset gamma correction lookup table, a grayscale value corresponding to the normalized first brightness value at the current brightness adjustment level may be determined as a first input grayscale value corresponding to the any pixel.

Specifically, after the first brightness value of the any pixel in all the pixels at the current brightness adjustment level is obtained and then normalized, and the normalized first brightness value 0.983 at the current brightness adjustment level is obtained, the grayscale value corresponding to the dimensionless value can be calculated based on the preset gamma correction lookup table, where the grayscale value is a corresponding actual input grayscale value, namely, the first input grayscale value, that the pixel should have for displaying the corresponding first brightness value and that exists when the display is at the current brightness adjustment level.

Specifically, an input grayscale value in the gamma correction lookup table is used as a horizontal coordinate, a corresponding output brightness value is used as a vertical coordinate, and a response curve $Y=(X+e)^{\gamma}$ between the input grayscale value and the output brightness value may be obtained, where Y represents the output brightness value, x represents the input grayscale value, e represents a compensation coefficient, and γ represents a power value for the curve, where the power value is also called a gamma value. The curve is the gamma curve corresponding to the gamma correction lookup table, and relationships between all grayscale values and brightness values in the preset gamma correction lookup table satisfy a power function relationship. In this case, a grayscale value corresponding to a second preset brightness value may be obtained based on the power function relationship in the gamma correction lookup table. For example, the curve corresponding to the gamma correction lookup table is shown in FIG. 2. A horizontal axis in FIG. 2 represents an input grayscale value, a vertical axis in FIG. 2 represents an output brightness value, and a gamma correction curve is shown as the solid curve in FIG. 2.

In an optional manner, the step of determining, based on the preset gamma correction lookup table, a first input grayscale value corresponding to the normalized first brightness value at the current brightness adjustment level may be specifically: first obtaining, according to Formula (2), the first input grayscale value corresponding to the normalized first brightness value at the current brightness adjustment level:

$$f=F_2^{1/\gamma}*(N-1) \tag{2}$$

where f represents the first input grayscale value corresponding to the normalized first brightness value at the current brightness adjustment level, γ represents a gamma value in the preset gamma correction lookup table, and N represents a total quantity of grayscale values.

After f is obtained, f may be determined as the input grayscale value corresponding to the any pixel.

Specifically, the gamma value in the preset gamma correction lookup table is a gamma value on the response curve. In an optional case, γ=2.2, or the like. It should be understood that a total quantity of grayscale levels indicates a total quantity of grayscale values based on a grayscale from black to white (corresponding to binary numbers of 0 and 1). For example, when an input grayscale value is an 8-bit value, there are 256, that is, 0 to 255, grayscale values. A grayscale value 0 corresponds to black, and a grayscale value 255 corresponds to white. When an input grayscale value is a 10-bit value, there are 1024 grayscale values. A grayscale value 0 corresponds to black, and a grayscale value 1023 corresponds to white. Different displays usually have different quantities of grayscale values. For example, when an input grayscale value is an 8-bit value, there may be $2^8=256$ grayscale values, and the 10-bit display may have $2^{10}=1024$ grayscale values. In other words, a value of N varies with the display. In this embodiment, N=1024, that is, the display has 1024 grayscale values in total.

In addition, in an optional manner, a result obtained through calculation according to the gamma correction formula may be a decimal, while grayscale values stored in the gamma correction lookup table are all integers. In this case, when the first brightness value at the current brightness adjustment level is not included in the gamma correction lookup table, the step of determining, based on a preset gamma correction lookup table, a first input grayscale value corresponding to the first brightness value may further specifically include: first obtaining, from the gamma correction lookup table, a brightness value closest to the first brightness value at the current brightness adjustment level; and then using a grayscale value corresponding to the brightness value closest to the first brightness value as the first input grayscale value corresponding to the first brightness value.

An example is used for description. After the normalized first brightness value 0.983 is obtained according to Formula (1), the value may be substituted into Formula (2) for calculation, to obtain $f=0.983^{1/2.2}*(1024-1)=1015.06$. The value is a decimal. However, in the existing discrete points used to represent the correspondences between the brightness values and the input grayscale values, a grayscale value corresponding to each discrete point is an integer. Therefore, the result is not included in the preset gamma correction lookup table. In this case, an integer closest to the calculation result may be used as a grayscale value corresponding to the calculation result, and brightness corresponding to a point indicating the grayscale value may be approximately considered as a corresponding brightness value at the current brightness adjustment level. Herein, because f=1015.06, an integer closest to the value off may be 1015. 1015 is the first input grayscale value corresponding to the normalized first brightness value at the current brightness adjustment level, and the first brightness value at the current brightness adjustment level may be approximately displayed based on a point indicating the grayscale value 1015 in all the discrete points.

When the series of discrete points are used to represent the correspondences between the brightness values and the input grayscale values, because each discrete point represents one integer grayscale value, grayscale values obtained based on these discrete points are relatively close to input grayscale values required for actually displaying the brightness values at the current brightness adjustment level. For example, in the foregoing calculation process, there is only a very small difference (0.06) between the grayscale value 1015 obtained through calculation and the first input grayscale value 1015.06 for actually displaying the first brightness value at the current brightness adjustment level. To be specific, the difference 0.06 is less than an integer grayscale value. When the preset gamma correction lookup table includes a relatively large quantity of grayscale values (for example, the 10-bit display has 1024 different grayscale values), a difference between brightness values corresponding to two adjacent grayscale values is relatively small. This can reduce used hardware resources such as memory space or a processing capability, and can relatively accurately represent a correspondence between an input grayscale value and a brightness value.

For example, in FIG. 2, assuming that the display performs display at the specified brightness adjustment level before the brightness is changed, the maximum brightness value of the display is 500 nits. In this case, an input grayscale value corresponding to a pixel with the brightness value of 500 nits is 1023, and an input grayscale value corresponding to another brightness value of a pixel at this level may be obtained based on a gamma curve at this level. For example, when the specified brightness adjustment level of the display is a level corresponding to the maximum brightness value of 500 nits, a gamma curve corresponding to the specified brightness adjustment level may be the gamma curve shown as the solid curve in FIG. 2. In this case, a vertical coordinate of a point b on the gamma curve represents a brightness value $F_1$ of a pixel at the specified brightness adjustment level, where it is assumed that the pixel has the same maximum brightness value as the display, that is, 500 nits, at the specified brightness adjustment level; and a horizontal coordinate of a point a represents a grayscale value corresponding to the brightness value $F_1$ of the pixel at the specified brightness adjustment level. It is easily understood that the grayscale value is 1023, as shown by the arrow 1.

When the brightness adjustment level of the display is adjusted from the specified brightness adjustment level to the current brightness adjustment level, the maximum brightness value is adjusted from 500 nits at the specified brightness adjustment level to 491.5 nits at the current brightness adjustment level. For example, in this case, a gamma curve corresponding to the display may be the gamma curve shown as the dashed-line curve. It should be understood that when the brightness adjustment level of the display is changed, a gamma curve corresponding to an input grayscale value of a pixel and a brightness value of the pixel is also changed, in other words, different levels correspond to different gamma curves. In this embodiment of this application, there is only one gamma curve. After the brightness adjustment level of the display is changed, based on the unique gamma curve, a gamma curve at another brightness adjustment level needs to be obtained, and an input grayscale value corresponding to each brightness value at a corresponding level needs to be obtained. In this case, the brightness value of the pixel is changed accordingly, and is changed to the brightness value $F_2$ at the current brightness adjustment level, as shown by the arrow 2 in FIG. 2. For example, the brightness value $F_2$ at the current brightness adjustment level is the same as the maximum brightness value of the display at the current brightness adjustment level, that is, 491.5 nits.

When the display is adjusted to the current brightness adjustment level, the maximum brightness value of the display is changed to 491.5 nits. In this case, when the input grayscale value is 1023, the corresponding brightness value is 491.5 nits. However, the gamma curve corresponding to the level at which the maximum brightness value is 491.5 nits does not actually exist. In this case, a specific actual input grayscale value corresponding to the brightness value displayed as 491.5 nits needs to be obtained based on the gamma curve corresponding to the specified brightness adjustment level at which the maximum brightness value is 500 nits, namely, based on the solid curve in FIG. 2; and the initial input grayscale value of the source image on the display is replaced with the actual input grayscale value, so that the display displays proper brightness of the pixel at the current brightness adjustment level. Specifically, a point, that is, the point a in FIG. 2, that corresponds to the new brightness value $F_2$ of the pixel at the current brightness adjustment level and that is on the gamma correction curve at the specified brightness adjustment level of the display needs to be used to obtain an input grayscale value corresponding to the brightness value $F_2$ at the current brightness adjustment level. Specifically, the point a is shown by the arrow 3.

In this case, a vertical coordinate of the point a represents the brightness value $F_2$ at the current brightness adjustment level, for example, both the point a and the display have the maximum brightness value of 491.5 nits at the current brightness adjustment level; and the horizontal coordinate of the point a represents the grayscale value f corresponding to the brightness value of the pixel at the current brightness adjustment level after the brightness adjustment level of the display is adjusted. The horizontal coordinate of the point a may be obtained based on a position of the point a on the gamma correction curve. For example, the horizontal coordinate of the point a is 1015, namely, the grayscale value f corresponding to the brightness value of the pixel at the current brightness adjustment level, as shown by the arrow 4. In this way, 1015 can be used as an actual input grayscale value of a pixel when the pixel displays brightness of 491.5 nits. Correspondingly, when the display is at the brightness adjustment level corresponding to the maximum brightness value of 491.5, an actual first input grayscale value corresponding to a first brightness value of another pixel on the display at the current brightness adjustment level may also be determined according to a same method.

It should be noted that the grayscale value of each pixel on the display usually has a range. In other words, the grayscale value is less than or equal to a maximum grayscale value. In this case, all points on the curve are located on the left of a vertical line whose horizontal coordinate is equal to the maximum grayscale value max. Generally, the maximum grayscale value is usually a grayscale value that is input when the display displays an all-white image.

In this embodiment, when the brightness of the display is adjusted, the correspondences between the input grayscale values of the display and the brightness values of the display always satisfy the gamma curve, and a grayscale color shift is prevented from occurring on brightness of the display during the adjustment. In addition, in the method, only one group of discrete data is required to represent the correspondences between the input grayscale values and the brightness values, and an actual input grayscale value that the display should have for displaying desired brightness after the brightness adjustment level of the display is changed is determined based on the group of discrete data. This reduces used storage space, and reduces hardware costs. In addition, a group of discrete data includes the correspondences between all the integer grayscale values and the corresponding brightness values. This implements higher precision of the determined input grayscale value, and implements higher brightness adjustment precision for the display.

Figure 3:
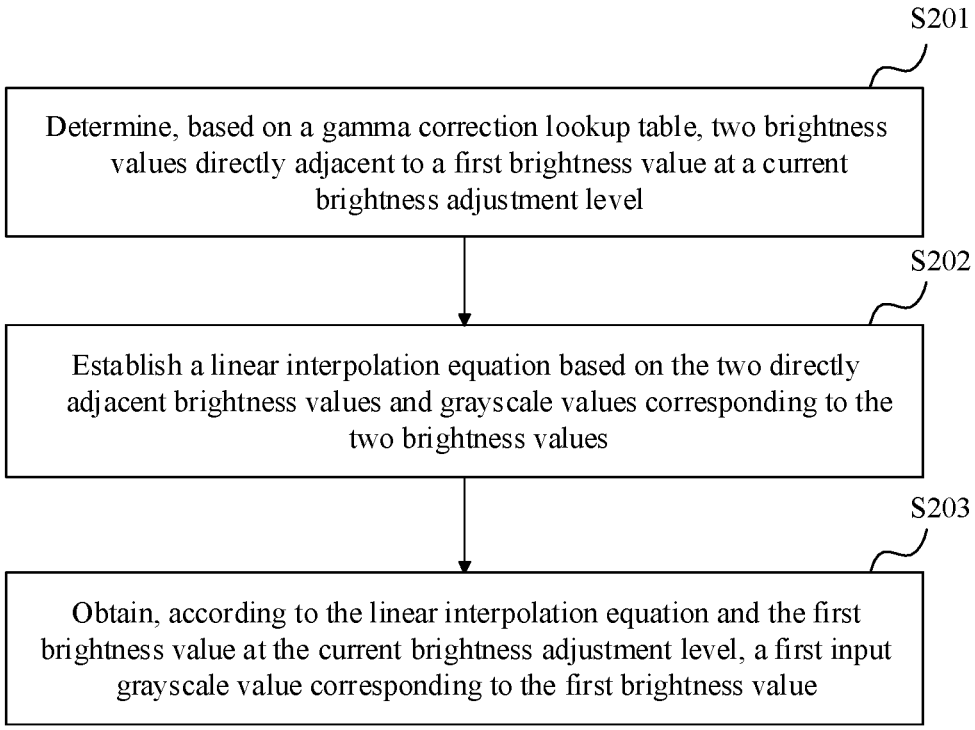
FIG. 3 is a schematic flowchart of determining a first input grayscale value corresponding to a first brightness value at a current brightness adjustment level according to an embodiment of this application.

To further reduce occupied storage space and reduce hardware costs, the preset gamma correction lookup table usually includes a limited quantity of discrete values. For example, only 30 typical correspondences between input grayscale values and brightness values may be measured. In this case, the preset correspondences are 30 groups of discrete points, and the 30 groups of discrete points are all located on a same gamma curve. Optionally, the preset correspondences may be referred to as the gamma correction lookup table. Optionally, the 30 groups of discrete points may be distributed on the gamma curve at equal intervals. In this way, although the gamma correction lookup table includes a plurality of grayscale values and corresponding brightness values, a quantity of grayscale values is less than a total quantity of grayscale values that can be input for the display. When the brightness adjustment level of the display is adjusted from the specified brightness adjustment level to the current brightness adjustment level, the brightness value of each pixel on the display at the current brightness adjustment level may not be included in the preset gamma correction lookup table. When step S102, that is, determining, based on a preset gamma correction lookup table, an input grayscale value corresponding to the brightness value at the current brightness adjustment level, in the method for controlling brightness of a display in Embodiment 1 is performed, a linear interpolation method may alternatively be used to calculate the grayscale value. FIG. 3 is a schematic flowchart of determining a first input grayscale value corresponding to a first brightness value at a current brightness adjustment level according to an embodiment of this application. As shown in FIG. 3, in this embodiment, in another optional implementation, the step of determining, based on a preset gamma correction lookup table, an input grayscale value corresponding to the brightness value at the current brightness adjustment level may specifically include the following steps.

S201: Determine, based on the gamma correction lookup table, two brightness values directly adjacent to the first brightness value at the current brightness adjustment level.

To reduce used hardware resources, the preset gamma correction lookup table includes only some of all gamma correction relationships between output brightness values and input grayscale values. If the display is adjusted from a specified brightness adjustment level to the current brightness adjustment level, and a first brightness value of a pixel at the current brightness adjustment level is not included in the some gamma correction relationships, a grayscale value approximate to a first input grayscale value corresponding to the first brightness value at the current brightness adjustment level may be obtained according to the linear interpolation method, and the approximate grayscale value is used as an actual input grayscale value of the display. In this way, the display can display proper brightness at the current brightness adjustment level.

The correspondences between the brightness values and the grayscale values in the gamma correction lookup table are all located on one gamma curve. In this case, when a length of an arc segment on the gamma curve is relatively small, a straight line may be used to approximately replace the arc segment; and a brightness value and a grayscale value that satisfy a linear equation for the straight line may also be approximately located on the gamma curve.

For example, several appropriate known correspondences between brightness values and grayscale values may be selected from the gamma correction lookup table. For example, two correspondences between output brightness values and input grayscale values may be selected, and linear interpolation calculation is performed based on the correspondences. Specifically, the two brightness values directly adjacent to the first brightness value at the current brightness adjustment level may be selected. The two brightness values are directly adjacent to the first brightness value at the current brightness adjustment level, in other words, the first brightness value at the current brightness adjustment level is located between the two brightness values; and the two brightness values are brightness values that are from the gamma correction lookup table and that are adjacent to the first brightness value at the current brightness adjustment level.

S202: Establish a linear interpolation equation based on the two directly adjacent brightness values and grayscale values corresponding to the two brightness values.

After the two brightness values directly adjacent to the first brightness value at the current brightness adjustment level are obtained, a linear interpolation equation that approximately satisfies a corresponding arc segment on the gamma curve, for example, a linear equation, may be established based on the two brightness values and the corresponding grayscale values. In an optional case, the linear equation is a monadic equation, and there is only one variable and one dependent variable. Based on a proper brightness value and a proper grayscale value, the linear equation can also approximately satisfy a relationship between the first brightness value and a corresponding first input grayscale value at the current brightness adjustment level. In this case, the linear equation may be used as the linear interpolation equation. For example, when the display is adjusted from the specified brightness adjustment level to the current brightness adjustment level, the linear interpolation equation can be established based on the two directly adjacent brightness values and the corresponding grayscale values.

Specifically, one of the brightness value and the grayscale value may be used as a variable of the equation, and the other is used as a dependent variable of the equation. A plurality of correspondences including a correspondence between the maximum brightness value of the display and the corresponding grayscale value of the display at the specified brightness adjustment level are substituted into the linear interpolation equation, to reversely derive a specific expression of the linear interpolation equation. For example, assuming that the maximum brightness value of the display at the specified brightness adjustment level is one of the two directly adjacent brightness values, the maximum brightness value of the display at the specified brightness adjustment level and the corresponding grayscale value may be used as a first group of variable and dependent variable, and a brightness value that is adjacent to the first brightness value at the current brightness adjustment level and that is less than the first brightness value and a corresponding grayscale value are selected from the preset gamma correction lookup table and used as a second group of variable and dependent variable; and the first group of variable and dependent variable and the second group of variable and dependent variable are used as known parameters of the equation, and an original parameter in the equation is used as a to-be-calculated value for calculation. A specific value of the original parameter in the equation can be reversely derived from a plurality of groups of variables and dependent variables. After the specific value of the parameter is substituted into the equation, the linear interpolation equation can be obtained. The following describes a process of obtaining the linear interpolation equation by using an example.

Figure 4:
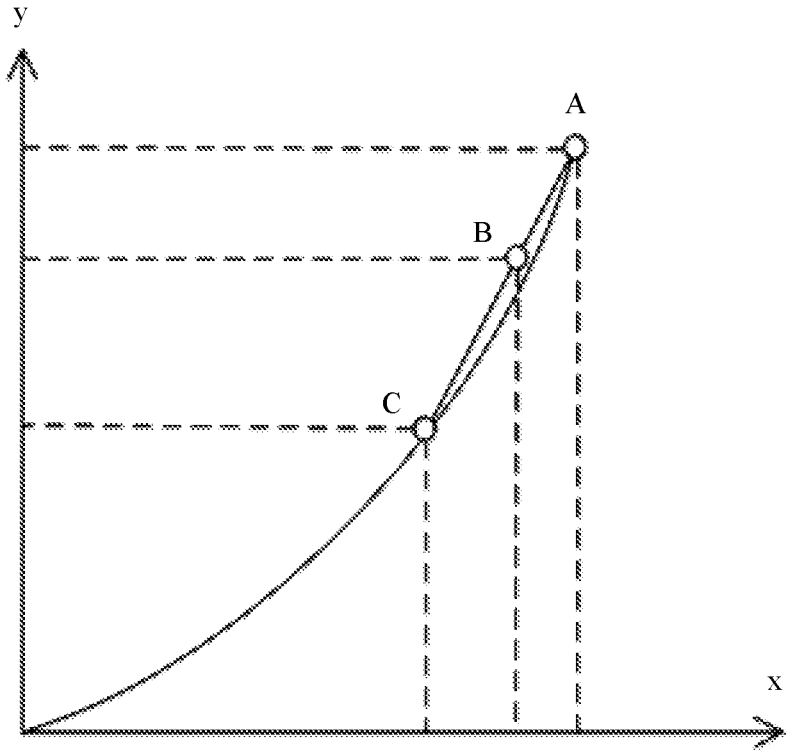
FIG. 4 is a schematic diagram of a gamma curve corresponding to a gamma correction lookup table in a method for controlling brightness of a display according to an embodiment of this application.

In an optional implementation, when the linear interpolation equation is established based on the two directly adjacent brightness values and the grayscale values corresponding to the two brightness values, the two brightness values directly adjacent to the first brightness value at the current brightness adjustment level are respectively the maximum brightness value at the specified brightness adjustment level and the other adjacent brightness value. FIG. 4 is a schematic diagram of a gamma curve corresponding to a gamma correction lookup table in a method for controlling brightness of a display according to an embodiment of this application. As shown in FIG. 4, both brightness values and grayscale values in the preset gamma correction lookup table are located on a same gamma curve, where a horizontal coordinate of the gamma curve represents an input grayscale value, and a vertical coordinate of the gamma curve represents a brightness value. A vertical coordinate and a horizontal coordinate of a point A on the gamma curve respectively represent the maximum brightness value of the display and the corresponding grayscale value of the display at the specified brightness adjustment level, and a vertical coordinate and a horizontal coordinate of a point B on the gamma curve respectively represent the brightness value of each pixel on the display at the specified brightness adjustment level and a grayscale value corresponding to the brightness value. In this case, a point C may be selected on the gamma curve. A vertical coordinate of the point C represents the other adjacent brightness value in the two directly adjacent brightness values, and a horizontal coordinate of the point C represents a grayscale value corresponding to the other adjacent brightness value.

A first brightness value of each pixel on the display at the current brightness adjustment level is located between the two directly adjacent brightness values. Therefore, the point B is also located between the point A and the point C. If a straight line is drawn based on the point A and the point C, the point B is also approximately located on the straight line. In this way, an equation expression of the straight line can be calculated based on the coordinates of the point A and the point C, and the equation expression is used as a linear interpolation equation for calculating the coordinates of the point B.

Specifically, a and b may be determined according to formulas $Y_1=a*X_1+b$ and $Y_2=a*X_2+b$.

$Y_1$ represents the maximum brightness value of the display at the specified brightness adjustment level, $X_1$ represents the grayscale value corresponding to the maximum brightness value of the display at the specified brightness adjustment level, $Y_2$ represents the brightness value corresponding to the point C, and $X_2$ represents the grayscale value corresponding to the point C.

The linear interpolation equation is an equation expression of a straight line, and the linear interpolation equation may be expressed as $y=a*x+b$, where x represents a horizontal coordinate, namely, a grayscale value, y represents a vertical coordinate, namely, a brightness value corresponding to the grayscale value, a represents a slope of the straight line represented by the linear interpolation equation, and b represents an intercept, on the y axis, of the straight line represented by the linear interpolation equation. The straight line represented by the linear interpolation equation includes the point A and the point C. Therefore, the horizontal coordinate and vertical coordinate of the point A and the horizontal coordinate and vertical coordinate of the point C can be substituted into the linear interpolation equation, to calculate values of a and b.

After the specific values of a and b are obtained in the foregoing step, a may be used to represent the slope of the straight line represented by the linear interpolation equation, b may be used to represent the intercept, on the y axis, of the straight line represented by the linear interpolation equation, and the linear interpolation equation is established based on the actual values of a and b. The straight line represented by the linear interpolation equation can be used to approximately simulate an arc segment between the point A and the point C on the gamma curve.

S203: Obtain, according to the linear interpolation equation and the first brightness value at the current brightness adjustment level, the first input grayscale value corresponding to the first brightness value.

After the linear interpolation equation is obtained based on the correspondences between the two directly adjacent brightness values and the grayscale values, a first brightness value of any pixel in all the pixels at the current brightness adjustment level may be used as a variable and substituted into the linear interpolation equation, and a calculated dependent variable of the equation may be approximately equal to a first input grayscale value corresponding to the first brightness value of the pixel at the current brightness adjustment level, as shown in step S303.

Specifically, in this step, an input grayscale value corresponding to the any pixel may be obtained according to the formula $y=a*x+b$, where y represents the first brightness value at the current brightness adjustment level, and x represents the first input grayscale value corresponding to the first brightness value at the current brightness adjustment level.

In this case, points whose vertical coordinates represent the first brightness value at the current brightness adjustment level and whose horizontal coordinates represent the first input grayscale value corresponding to the first brightness value at the current brightness adjustment level are all located on the straight line whose slop is a and whose intercept on they axis is b. After the specific values of a and b are calculated, the grayscale value corresponding to the any pixel in all the pixels may be directly calculated according to the formula. The foregoing processing is performed on each pixel on the display, to obtain a first input grayscale value that should be input for each pixel when the display is at the current brightness adjustment level. In addition, the linear interpolation equation may alternatively be established according to another linear interpolation algorithm, a specific expression of the linear interpolation equation is determined based on the relationships between the input grayscale values and the brightness values in the preset gamma correction lookup table, a first input grayscale value corresponding to the first brightness value at the current brightness adjustment level is calculated according to the linear interpolation equation, and the first input grayscale value is used as the first input grayscale value corresponding to the first brightness value of the any pixel in all the pixels at the current brightness adjustment level.

In this embodiment, when the brightness of the display is adjusted, the input grayscale value of the display and the brightness value of the display always satisfy the gamma curve, and in the adjustment process, a grayscale color shift and flickering are prevented from occurring on the display. In addition, in this method, only the gamma correction relationship at the specified brightness adjustment level is required, to determine a correspondence between a brightness value and an input grayscale value at the another brightness adjustment level, and perform, based on the gamma correction relationship at the specified brightness adjustment level, gamma correction on brightness displayed by the display at the another brightness adjustment level, without a need to store a gamma correction relationship at the another level. This reduces used storage space, and reduces hardware costs. In addition, the used preset gamma correction lookup table includes only the limited quantity of correspondences between the input grayscale values and the brightness values, and other correspondences not included in the preset gamma correction lookup table are obtained through simple linear interpolation calculation. In this way, precision of an input grayscale value is relatively high, a calculation speed is high, and processor overheads are relatively low.

Figure 5:
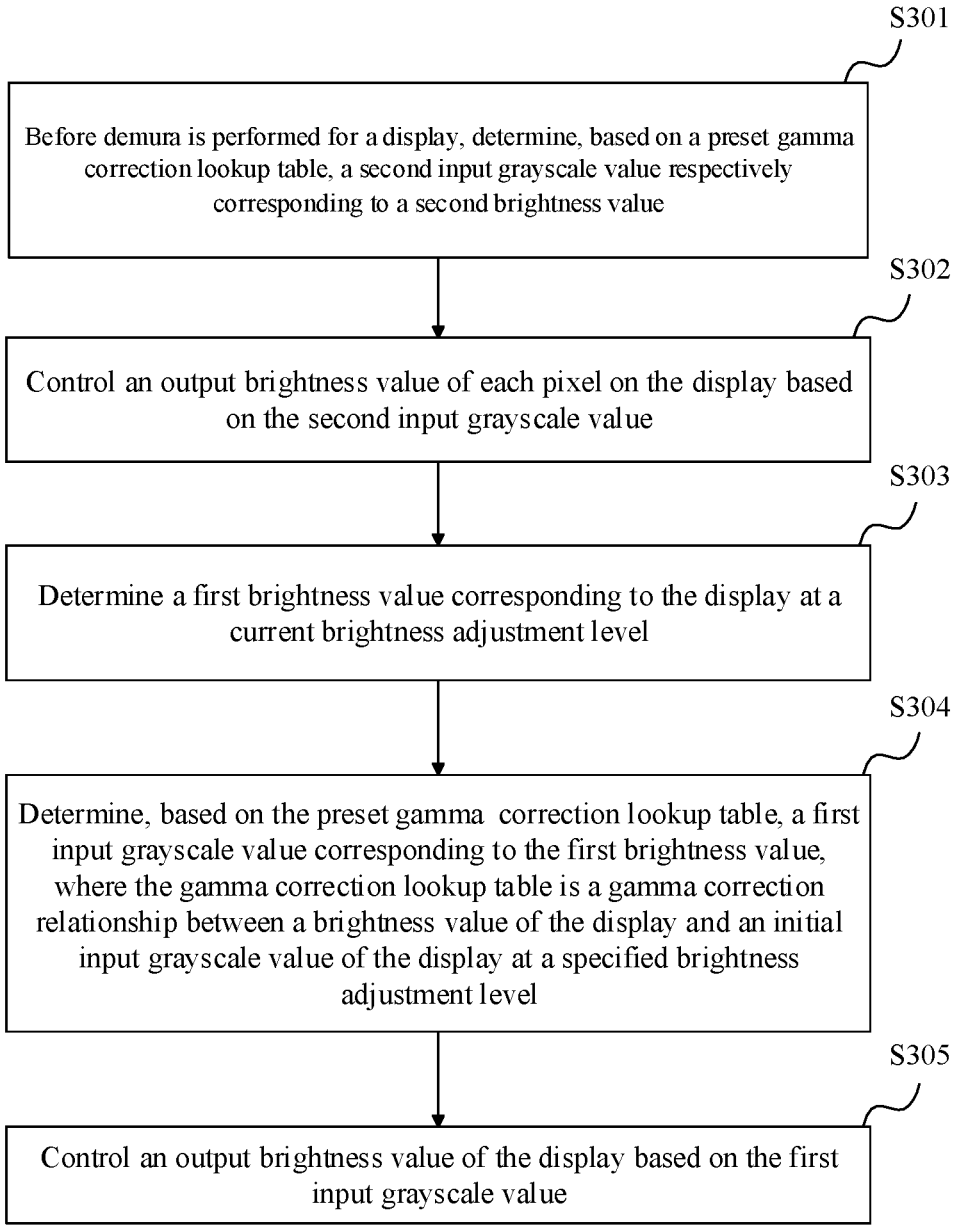
FIG. 5 is a schematic flowchart of another method for controlling brightness of a display according to an embodiment of this application.

When the display is a display such as an AMOLED, a light emitting characteristic of a pixel is changed during production of an AMOLED display panel due to a process (for example, an evaporation process in which uniformity of a coating layer on the entire panel and a coating layer thickness are controlled). In this case, when a same drive voltage is applied, a current flowing through the pixel is different. Consequently, a brightness Mura phenomenon occurs when the pixel on the display performs display. To correct the Mura phenomenon occurring on the display, compensation, namely, a demura step, further needs to be performed for the display to eliminate the Mura phenomenon. Therefore, based on the foregoing embodiment, a step used to eliminate the Mura phenomenon may further be added to the method for controlling brightness of a display. FIG. 5 is a schematic flowchart of another method for controlling brightness of a display according to an embodiment of this application. As shown in FIG. 5, when the display includes a Mura region, and a brightness value of each pixel on the display at an initial brightness adjustment level is a second brightness value, to correct and compensate for a Mura phenomenon that occurs on the display while controlling brightness of the display, before determining a brightness value of the display at a current brightness adjustment level, the method for controlling brightness of a display provided in this embodiment may further include the following steps.

S301: Before demura is performed for the display, determine, based on a preset gamma correction lookup table, a second input grayscale value corresponding to the second brightness value.

Specifically, when the display performs display, an image output by the display is distorted compared with an input image due to sensitivities of human eyes or a photoelectric characteristic of the display. To avoid a deviation between a brightness value of the display and a brightness value of the original image, an input grayscale value of the display needs to be corrected. Specifically, when gamma correction is performed, gamma compensation may be performed on each pixel on the display based on the preset gamma correction lookup table, to obtain an input grayscale value of the pixel when a brightness value of the pixel on the display at a specified brightness adjustment level is the second brightness value. This can correct a brightness deviation of the image actually displayed by the display. For a specific manner and step of obtaining the input grayscale value, refer to specific descriptions in step S102 in the foregoing embodiment. Details are not described herein again.

When second brightness values of all pixels on the display at the initial brightness adjustment level are the same, for example, are a maximum brightness value of the display at the initial brightness adjustment level, the display displays a pure-color image. In this way, the second input grayscale value corresponding to the maximum brightness value of each pixel when the display is at the initial brightness adjustment level can be determined based on the preset gamma correction lookup table.

S302: Control an output brightness value of each pixel on the display based on the second input grayscale value.

After the second input grayscale value is obtained, the input grayscale value of each pixel may be determined as the second input grayscale value. In this case, each pixel on the display should display brightness with the second brightness value corresponding to the second input grayscale value. In this way, brightness of each pixel can be controlled based on the second input grayscale value, so that the display performs display.

In this case, the display includes the Mura region, in other words, pixels whose brightness values are unequal exist in all the pixels, and therefore, demura adjustment needs to be performed, so that all the pixels maintain uniform brightness during display of the image.

Specifically, because the Mura phenomenon may occur on the display, when the same grayscale value is input for all the pixels on the display, brightness presented in some regions or by some pixels may be different from brightness output by other pixels. In this case, a demura step needs to be performed, so that a same brightness value can be correspondingly output for the same input grayscale value of all the pixels on the display. Because Mura compensation is based on brightness data obtained after the gamma correction, in a compensation step, the gamma correction needs to be performed for all the pixels on the display based on the preset gamma correction lookup table, so that the output brightness value of the display and the input grayscale value of the display satisfy a gamma curve.

There are many kinds of compensation methods, for example, internal compensation or external compensation. During the compensation, an actual corresponding brightness value is usually obtained when a specified grayscale value, for example, the second input grayscale value, is input for each pixel; or an input grayscale value corresponding to each pixel is usually obtained when the pixel outputs brightness with a specific brightness value, for example, with the maximum brightness value of the display at the initial brightness adjustment level; and the compensation is performed based on a relationship between the grayscale value of each pixel and the brightness value of the pixel, so that input and output features of all the pixels on the display are the same.

Specifically, during the compensation, the same second input grayscale value may usually be input for all the pixels on the display. In this case, if there is no Mura region on the display, brightness output by the display should be the same, and is the second brightness value. In this case, a device such as a high power camera may be used to photograph the display to obtain actual brightness of each pixel on the display. If the Mura phenomenon occurs on the display, brightness of a pixel in a region in which the Mura phenomenon occurs is different from brightness of a pixel outside the region. In this case, data photographed by the camera is analyzed, and then compensation data, for example, a Mura compensation table, may be used to compensate for the brightness of each pixel, so that the entire display can display uniform brightness. Specifically, the compensation data may include coordinates of a to-be-compensated pixel on the display and a correspondence between grayscale values before and after the compensation when the pixel displays uniform brightness.

To facilitate subsequent brightness control, in step S301, the brightness value of each pixel on the display may be set to the maximum brightness value of the display at the initial brightness adjustment level, that is, brightness of the display when the display displays an all-white color at the brightness adjustment level. For example, when the entire display outputs brightness with the maximum brightness value, the Mura compensation data may be used to change or replace an input grayscale value of the pixel in the Mura region. In this way, the pixel in the Mura region can output same brightness as a pixel in another region.

After the demura step is performed, compensation is performed for the Mura phenomenon occurring on the display, so that all the pixels on the display have uniform brightness.

S303: Determine a first brightness value of the display at the current brightness adjustment level.

After the demura step is performed, the display can display uniform brightness. Then, a corresponding first brightness value of each pixel for performing proper display at the current brightness adjustment level may be determined based on the current brightness adjustment level.

S304: Determine, based on the preset gamma correction lookup table, a first input grayscale value corresponding to the first brightness value, where the gamma correction lookup table includes a gamma correction relationship between a brightness value of the display and an initial input grayscale value of the display at a specified brightness adjustment level.

When brightness control is performed for the display, for example, when a brightness adjustment level of the display is adjusted from the original specified brightness adjustment level to the current brightness adjustment level, the brightness of each pixel on the display also needs to be changed accordingly, to ensure correct display of an image. To determine a display output of the display for the image, the first input grayscale value that each pixel on the display should have for displaying the first brightness value at the current brightness adjustment level needs to be re-determined based on a feature of a gamma curve between an input and an output of the display.

Specifically, a relationship between an input grayscale value and an output brightness value of the display may be obtained based on the preset gamma correction lookup table. When the display is at the current brightness adjustment level, the preset gamma correction lookup table may further be used to obtain the first input grayscale value that needs to be actually input for each pixel on the display to maintain the corresponding first brightness value at the current brightness adjustment level. An actual input grayscale value of each pixel on the display may be calculated according to a formula based on the preset gamma correction lookup table. For specific steps, refer to related descriptions in the steps in the foregoing embodiment. Details are not described herein again.

S305: Control an output brightness value of the display based on the first input grayscale value.

After the actual first input grayscale value that each pixel should have for displaying the corresponding brightness is obtained, where each pixel should have the actual first input grayscale to enable the display to properly display the image after a change in the brightness, the first input grayscale value may be used as an actual input for each pixel, and accurate brightness is output based on the preset gamma correction lookup table, so that the image is accurately displayed when the display is adjusted to the current brightness adjustment level.

In this embodiment, the same second grayscale value needs to be input for all the pixels on the display initially; Mura compensation is performed to enable all the pixels on the display to present the same brightness; and, when the brightness of the display is adjusted, accurate correspondences between input grayscale values and output brightness values of all the pixels are obtained after the brightness of the display is changed, so that image brightness that is displayed by the display is the same as image brightness that is expected to be displayed by the display. The brightness of the display is corrected based on the same preset gamma correction lookup table before and after the Mura compensation step. This can maintain uniform brightness on the display by performing the Mura compensation step, and controls the brightness of the display. In addition, there is an accurate correspondence between the input grayscale value and the output brightness value of the display, so that the image displayed by the display displays proper brightness and a proper brightness change. In comparison with an existing brightness control method in which a Mura compensation step and a gamma correction step are separately performed, and the Mura compensation step is performed by an optical equipment manufacturer while the gamma correction step is mainly performed by a driver chip manufacturer, the brightness control method in this embodiment requires only the same preset gamma correction lookup table, and the preset gamma correction lookup table can be integrated into a same hardware architecture. This implements relatively good integration.

In this embodiment, before the demura is performed for the display, gamma correction is performed for the display including the Mura region; and in a brightness adjustment process, gamma correction is performed for the display for which a demura operation has been performed. This can ensure uniform brightness on the display, and can enable the display to display accurate brightness in the entire brightness adjustment process. In addition, the gamma correction that is performed before the demura is performed based on the same gamma correction lookup table in the brightness adjustment process. This can implement relatively good hardware integration, reduce used storage space, and reduce hardware costs.

Figure 6:
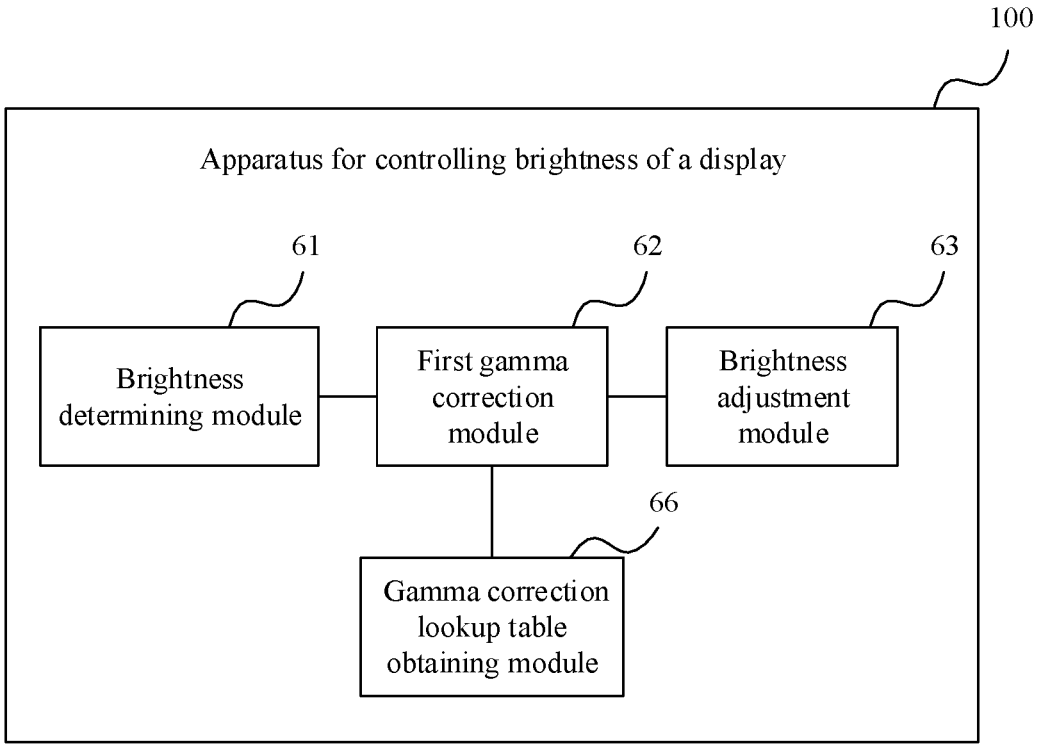
FIG. 6 is a schematic structural diagram of an apparatus for controlling brightness of a display according to an embodiment of this application.

An embodiment of this application further provides an apparatus 100 for controlling brightness of a display, to perform the method for controlling brightness of a display in the foregoing embodiments. As shown in FIG. 6, the apparatus 100 for controlling brightness of a display provided in this embodiment may include:

a brightness determining module 61, configured to determine a first brightness value of the display at a current brightness adjustment level;

a first gamma correction module 62, configured to determine, based on a preset gamma correction lookup table, a first input grayscale value corresponding to the first brightness value, where the gamma correction lookup table includes a gamma correction relationship between a brightness value of the display and an initial input grayscale value of the display at a specified brightness adjustment level; and a brightness adjustment module 63, configured to control an output brightness value of the display based on the first input grayscale value. For specific functions of the brightness determining module 61, the first gamma correction module 62, and the brightness adjustment module 63, refer to descriptions in steps S101 to S103 on the method side.

Optionally, the gamma correction lookup table may include a plurality of discrete grayscale values and a plurality of brightness values, where a quantity of the grayscale values is equal to a quantity of the brightness values, the grayscale values one-to-one correspond to the brightness values, and the quantity of the discrete grayscale values is equal to a total quantity of grayscale values of the display.

Alternatively, the gamma correction lookup table may include a plurality of discrete grayscale values and a plurality of brightness values, where a quantity of the grayscale values is equal to a quantity of the brightness values, the grayscale values one-to-one correspond to the brightness values, and the quantity of discrete grayscale values is less than a total quantity of grayscale values of the display.

Optionally, two-dimensional coordinate points constituted by the discrete grayscale values and brightness values that one-to-one correspond to the discrete grayscale values are all located on a gamma curve, where a horizontal coordinate of the gamma curve represents a grayscale value, and a vertical coordinate of the gamma curve represents a brightness value.

Optionally, a current brightness value of the display at the current brightness adjustment level and a previous brightness value of the display at a previous brightness adjustment level satisfy a preset condition, where the current brightness value and the previous brightness value correspond to a same input grayscale value, the preset condition is that a ratio of a difference between the current brightness value of the current brightness adjustment level and the previous brightness value of the previous brightness adjustment level to the previous brightness value satisfies the Webber law, and the difference between the brightness values is a difference between the current brightness value and the previous brightness value.

Optionally, a maximum brightness value supported by the display at the specified brightness adjustment level is greater than a maximum brightness value supported by the display at the current brightness adjustment level.

Optionally, the specified brightness adjustment level is a maximum level supported when brightness of the display is adjusted.

Optionally, the first gamma module 62 is specifically configured to: first determine the initial input grayscale value corresponding to the display when the brightness value of the display is the corresponding first brightness value at the current brightness adjustment level; and then replace the initial input grayscale value with the input grayscale value determined based on the gamma correction lookup table, and use the input grayscale value as the first input grayscale value corresponding to the first brightness value.

Optionally, correspondences between the plurality of grayscale values and the plurality of brightness values in the gamma correction lookup table satisfy a gamma correction formula, where the brightness value is used as an input of the gamma correction formula, and the grayscale value is used as an output of the gamma correction formula. In this case, the control apparatus may further include a gamma correction lookup table obtaining module 66, configured to calculate, based on the plurality of brightness values and the correction formula, a plurality of grayscale values that one-to-one correspond to the plurality of brightness values.

Optionally, when the first brightness value at the current brightness adjustment level is not included in the gamma correction lookup table, the first gamma correction module 62 is further configured to: first obtain, from the gamma correction lookup table, a brightness value closest to the first brightness value at the current brightness adjustment level, and then use a grayscale value corresponding to the brightness value closest to the first brightness value at the current brightness adjustment level as the first input grayscale value corresponding to the first brightness value.

Optionally, when the first brightness value at the current brightness adjustment level is not included in the gamma correction lookup table, the first gamma correction module 62 is specifically configured to: determine, based on the gamma correction lookup table, two brightness values directly adjacent to the first brightness value at the current brightness adjustment level; establish a linear interpolation equation based on the two directly adjacent brightness values and grayscale values corresponding to the two brightness values; and obtain, according to the linear interpolation equation and the first brightness value at the current brightness adjustment level, the first input grayscale value corresponding to the first brightness value.

Optionally, to eliminate a brightness Mura phenomenon that occurs on a pixel when the display performs display, and ensure uniform brightness on the display, an initial brightness value of each pixel on the display is preset to a second brightness value, and the obtaining module 66 is further configured to: determine, based on the preset gamma correction lookup table, a corresponding second input grayscale value that exists when a brightness value corresponding to the initial brightness adjustment level is the second brightness value; and then use the second input grayscale value as an input grayscale value of each pixel on the display.

Figure 7:
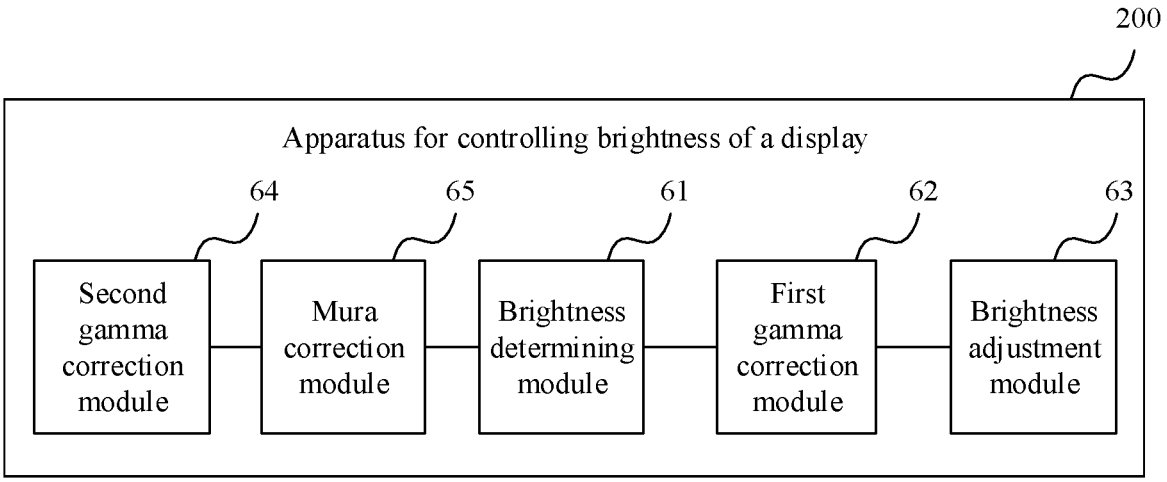
FIG. 7 is a schematic structural diagram of another apparatus for controlling brightness of a display according to an embodiment of this application.

In this case, to ensure uniform brightness on the display, FIG. 7 shows another apparatus 200 for controlling brightness of a display. Similar to the apparatus 100 for controlling brightness of a display in FIG. 6, the apparatus 200 for controlling brightness of a display also includes the foregoing modules, and the apparatus 200 for controlling brightness of a display may further include:

a second gamma correction module 64, configured to: before demura is performed for the display, determine, based on the preset gamma correction lookup table, a second input grayscale value corresponding to the second brightness value.

The second gamma correction module 64 is further configured to use the second input grayscale value as an input grayscale value of each pixel on the display.

In addition, the apparatus further includes a Mura correction module 65, configured to perform the demura for the display. For specific functions of the second gamma correction module 64 and the Mura correction module 65, refer to descriptions in steps S301 and S302 on the foregoing method side.

It should be noted that division into the modules of the apparatuses in FIG. 6 and FIG. 7 is merely logical function division, and in an actual implementation, all or some of the modules may be integrated into one physical entity, or the modules may be physically separate. In addition, all of the modules may be implemented in a form of software invoked by a processing element or in a form of hardware. Alternatively, some of the modules may be implemented in a form of software invoked by a processing element, and some of the modules may be implemented in a form of hardware. For example, the first gamma correction module 62 may be a processing element that is separately disposed, or may be integrated into a chip of the apparatus. In addition, the first gamma correction module 62 may be stored in a memory of the apparatus in a form of a program, and invoked by a processing element of the apparatus to perform a function of the first gamma correction module 62. Implementations of other modules are similar. In addition, all or some of the modules may be integrated, or may be implemented independently. The processing element may be an integrated circuit and has a signal processing capability. In an implementation process, steps in the foregoing methods or the foregoing units may be implemented by a hardware integrated logic circuit in the processing element, or by instructions in a form of software.

For example, the modules may be configured as one or more integrated circuits for implementing the foregoing methods, for example, one or more application-specific integrated circuits (ASIC), one or more digital signal processors (DSP), or one or more field programmable gate arrays (FPGA). For another example, when one of the foregoing modules is implemented in a form of a processing element invoking a program, the processing element may be a general-purpose processor, for example a central processing unit (CPU) or another processor that can invoke the program. For still another example, these modules may be integrated together, and implemented in a form of a system-on-a-chip (SOC).

Figure 8:
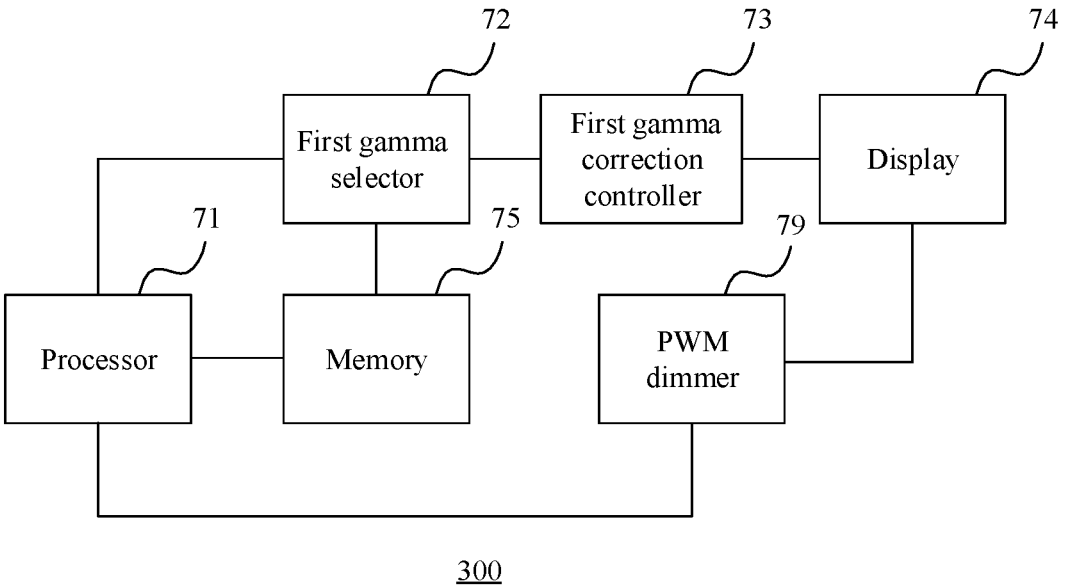
FIG. 8 is a schematic diagram of a hardware structure of a terminal device according to an embodiment of this application.

FIG. 8 is a schematic diagram of a hardware structure of a terminal device 300 according to an embodiment of this application. As shown in FIG. 8, the terminal device 300 includes a processor 71, a first gamma selector 72, a first gamma correction controller 73, and a display 74.

The processor 71 is configured to determine a first brightness value of the display 74 at a current brightness adjustment level.

The first gamma selector 72 is configured to determine, based on a preset gamma correction lookup table, a first input grayscale value corresponding to the first brightness value, where the gamma correction lookup table includes a gamma correction relationship between a brightness value of the display and an initial input grayscale value of the display at a specified brightness adjustment level.

The first gamma correction controller 73 is configured to control an output brightness value of the display based on the first input grayscale value.

In this way, the terminal device in this embodiment can execute the method for controlling brightness of a display in the foregoing embodiments. Specific processes and steps of the method for controlling brightness of a display have been described in the foregoing embodiments. Details are not described herein again.

After the processor 71 determines the first brightness value, the first gamma selector 72 may determine, based on the preset gamma correction lookup table, the first input grayscale value corresponding to the first brightness value, and then the first gamma correction controller 73 controls the output brightness value of the display 74 based on the first input grayscale value. A specific function of the first gamma selector 72 is similar to the function of the first gamma correction module 62 in the foregoing embodiment, and a specific function of the first gamma correction controller 73 is similar to the function of the brightness adjustment module 63 in the foregoing embodiment. Details are not described herein again.

The first gamma selector 72 may be integrated into the processor 71, or may be a hardware logic circuit or a hardware circuit independent of the processor 71. The first gamma correction controller 73 may usually be hardware, for example, a drive circuit, independent of the processor 71.

In addition, optionally, the terminal device 300 may further include a memory 75. The memory 75 is configured to store the preset gamma correction lookup table.

The display 74 is usually constituted by an organic light emitting display (OLED for short) or an active-matrix organic light emitting diode (AMOLED). An example in which the display 74 is an OLED display is used for description. To enable each pixel on the OLED display to output and display expected brightness and an expected color, the first gamma correction controller in the terminal device may generate a corresponding drive voltage based on the input grayscale value obtained by the first gamma selector. When different voltages are applied to the display, different brightness may be displayed. In this way, a brightness value corresponding to the input grayscale value is displayed.

Specifically, the first gamma correction controller 73 may include a voltage generator and a brightness controller. The voltage generator can be configured to generate a corresponding reference voltage based on an input grayscale value; and the brightness controller may be configured to control, based on the reference voltage, the display to display brightness with a brightness value corresponding to the input grayscale value.

The input grayscale value is usually a digital signal. To convert the input grayscale value into an analog voltage value, optionally, the voltage generator may be a digital-to-analog converter (DAC). The digital-to-analog converter is configured to convert the input grayscale value into an analog reference voltage value. In this way, the brightness controller can control the brightness value of the display based on the reference voltage, so that the display displays corresponding brightness after being powered on. Specifically, after receiving the input grayscale value that is presented as the digital signal, the digital-to-analog converter can convert the input grayscale value into an actual reference voltage value. The reference voltage value corresponding to the input grayscale value varies with the input grayscale value. In this way, the display may emit light with different brightness based on different reference voltage values and current values, to display an actual image.

Data and a signal may be transmitted between the processor 71, the first gamma selector 72, the first gamma correction controller 73, and the memory 75 through a communications bus or another data path. Because the memory 75, the processor 71, the first gamma selector 72, and the first gamma correction controller 73 are electrically connected to each other, the preset gamma correction lookup table stored in the memory 75 may be transmitted to the first gamma selector 72, so that the first gamma selector 72 searches the preset gamma correction lookup table for an input grayscale value of each pixel after a brightness adjustment level of the display 74 is changed, and the first gamma correction controller 73 controls, based on the input grayscale value, an output brightness value and the like of each pixel on the display 74.

The processor 71 is usually a control center of the terminal device, and may be directly connected to different hardware components such as the memory 75 through the communications bus. The processor 71 performs various functions of the terminal device and processes data by running or executing a software program and/or a module and invoking data stored in the memory, to complete an operation for controlling brightness of the display. The processor 71 may be a microcontroller unit (MCU), a central processing unit (CPU), or an independent system-on-a-chip (SOC), or may be one or more integrated circuits configured to implement the foregoing method, for example, one or more ASIC, one or more DSP, or one or more FPGA.

Optionally, the processor 71 may include one or more processing units. Different processing units are configured to respectively execute the foregoing different instructions and programs, to respectively perform different functions.

The memory 75 may be a read-only memory (ROM) or another type of static storage device that can store static information and instructions, or a random access memory (RAM) or another type of dynamic storage device that can store information and instructions, or may be an electrically erasable programmable read-only memory (EEPROM), a compact disc read-only memory (CD-ROM) or another compact disc storage, an optical disc storage (including a compact disc, a laser disc, an optical disc, a digital versatile disc, a Blu-ray disc, and the like), a magnetic disk storage medium or another magnetic storage device, or any other medium that can be configured to carry or store expected program code in a form of an instruction or a data structure and that can be accessed by a computer. However, the memory 75 is not limited thereto. The memory 75 may exist independently, and is connected to the processor 71 and the first gamma selector 72 through a bus. Alternatively, the memory 75 may be integrated with the processor 71.

Optionally, in addition to storing the preset gamma correction lookup table, the memory 75 may be further configured to store application program code for executing the solutions of this application, and the processor 71 controls the execution. The processor 71 is configured to execute the application program code stored in the memory 75, to implement the method for controlling brightness of a display provided in the foregoing embodiments of this application.

Figure 9:
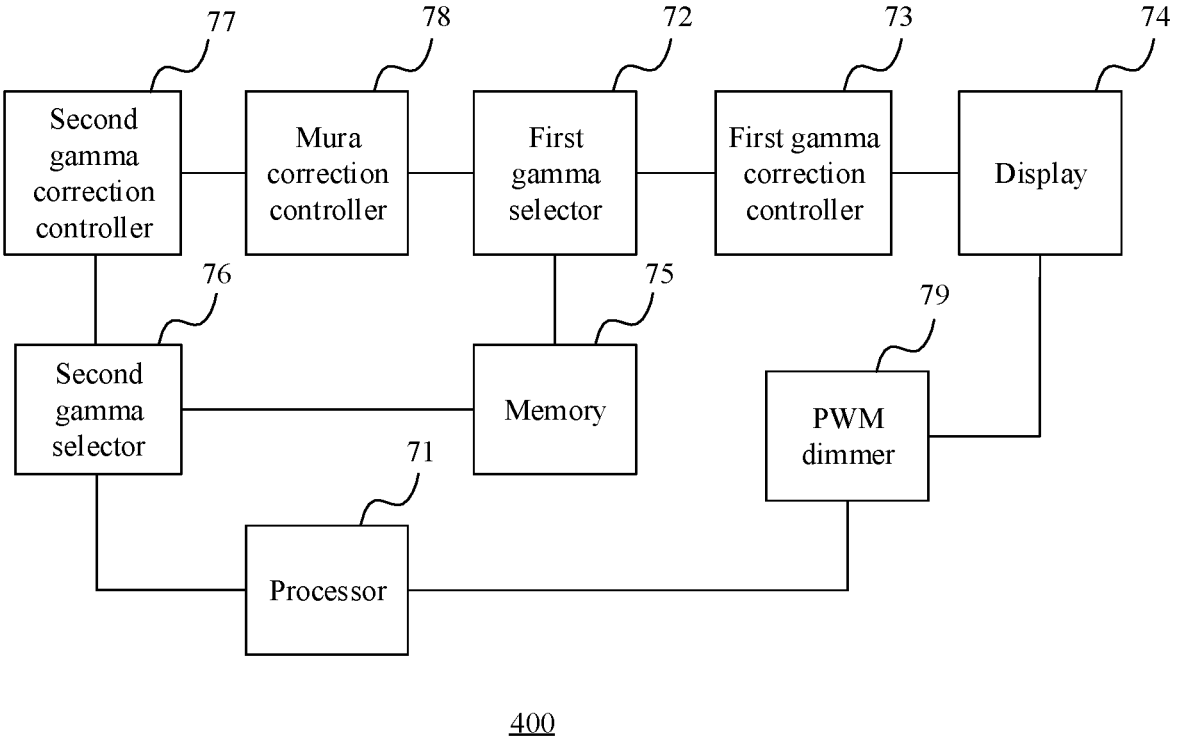
FIG. 9 is a schematic diagram of a hardware structure of another terminal device according to an embodiment of this application.

In addition, a light emitting characteristic of a pixel often changes due to techniques used for an OLED display or an AMOLED display. Consequently, a brightness Mura phenomenon occurs when the pixel on the display performs display. To eliminate the brightness Mura phenomenon on the OLED display, optionally, the terminal device may be further configured to perform a demura step, to compensate for the pixel with a Mura brightness value. FIG. 9 shows another terminal device 400. Similar to the terminal device in FIG. 8, the terminal device 400 also includes the processor 71, the first gamma selector 72, the first gamma correction controller 73, and the display 74. In addition, if a brightness value of each pixel on the display 74 at an initial brightness adjustment level is a second brightness value, the terminal device 400 may further include a second gamma selector 76 and a second gamma correction controller 77. The second gamma selector 76 is configured to: before demura is performed for the display 74, determine, based on a preset gamma correction lookup table, a second input grayscale value corresponding to the second brightness value. The second gamma correction controller 77 is configured to control an output brightness value of each pixel on the display based on the second input grayscale value. Specifically, functions of the second gamma selector 76 and the second gamma correction controller 77 are the same as those of the second gamma correction module in the foregoing embodiment. Details are not described herein again.

The second gamma selector 76 may be integrated into the processor 71, or may be hardware independent of the processor 71. The second gamma correction controller 77 is usually hardware, for example, a drive circuit, independent of the processor 71.

Specifically, the terminal device 400 needs to cooperate with another external device to obtain Mura compensation data. The external device usually includes a sensor element configured to sense actual brightness of the display 74. For example, the sensor element may be a high power camera. When the display 74 is driven by a test signal to perform display, the brightness value of each pixel on the display 74 at the initial brightness adjustment level is the second brightness value. In this case, the second gamma selector 76 determines, based on the preset gamma correction lookup table, the second input grayscale value corresponding to the second brightness value, and the second gamma correction controller 77 controls the output brightness value of each pixel based on the second input grayscale value. In this case, the sensor element measures the actual brightness of the display 74, and then the terminal device 400 may obtain the Mura compensation data, for example, a Mura compensation table, based on a relationship between the actual brightness of the display 74 and an input grayscale value, and compensate for, based on the Mura compensation table, brightness of each pixel on the display 74, so that the entire display 74 can display uniform brightness. In this embodiment, for example, the brightness value of each pixel on the display 74 may maintain the second brightness value.

For example, the terminal device 400 may include a Mura correction controller 78 that is specially configured to obtain the Mura compensation data and perform Mura compensation. The Mura correction controller 78 may be integrated into the processor 71, or may be independent hardware, an independent circuit, or the like.

In addition, the second gamma correction controller 77 may also include a voltage generator and a brightness controller. The voltage generator can be configured to generate a corresponding reference voltage based on an input grayscale value; and the brightness controller may be configured to control, based on the reference voltage, the display to display brightness with a brightness value corresponding to the input grayscale value. For specific structures and functions of the voltage generator and the brightness controller, refer to the descriptions in the foregoing embodiment. Details are not described herein again.

To cooperate with the external device such as the high power camera, the terminal device may further include an I/O subsystem that is configured to connect the external device and the terminal device. The I/O subsystem may be configured to exchange data with the external device, to implement input and output of data collected by the external device, control a working status of the external device, and so on.

In addition, the terminal device further includes a pulse width modulation (PWM) dimmer 79. The PWM dimmer 79 can modulate on/off of an internal switch device such as a transistor gate or a MOS transistor base, to generate a series of pulses with an equal width, and implement different equivalent analog output by changing a width or duty cycle of a pulse, thereby adjusting output brightness of the display 74. For example, the PWM dimmer 79 is electrically connected to the display 74. The PWM dimmer 79 may receive a digital signal from a control chip, and convert the digital signal into pulses with different widths or duty cycles. This is equivalent to outputting voltage signals with different amplitudes. Each pixel on the display 74 displays different brightness based on the different amplitudes of the voltage signals. This implements brightness adjustment and proper display of an image. For example, the PWM dimmer 79 may be electrically connected to the processor 71, or may be used as a part of a gamma correction controller, to adjust, based on data such as the input grayscale value, the brightness of the display 74.

All or some of the foregoing embodiments may be implemented by using software, hardware, firmware, or any combination thereof. When a software program is used to implement the embodiments, the embodiments may all or partially be implemented in a form of a computer program product. The computer program product includes one or more computer instructions. When the computer program instructions are loaded and executed on a computer, the procedures or functions according to the embodiments of this application are all or partially generated. The computer may be a general-purpose computer, a dedicated computer, a computer network, or other programmable apparatuses. The computer instructions may be stored in a computer-readable storage medium or may be transmitted from a computer-readable storage medium to another computer-readable storage medium. For example, the computer instructions may be transmitted from a website, computer, server, or data center to another website, computer, server, or data center in a wired (for example, a coaxial cable, an optical fiber, or a digital subscriber line (DSL)) or wireless (for example, infrared, radio, or microwave) manner. The computer-readable storage medium may be any usable medium accessible by a computer, or a data storage device, such as a server or a data center, integrating one or more usable media. The usable medium may be a magnetic medium (for example, a floppy disk, a hard disk, or a magnetic tape), an optical medium (for example, a DVD), a semiconductor medium (for example, a solid-state drive (SSD)), or the like.

What is claimed is:

1. A method for controlling display brightness, comprising:

determining a first brightness value of a display at a current brightness adjustment level;

determining, based on a gamma correction lookup table, a first input grayscale value corresponding to the first brightness value, wherein the gamma correction lookup table comprises a gamma correction relationship between a brightness value of the display and an initial input grayscale value of the display at a predetermined brightness adjustment levels; and controlling, by a first gamma correction controller, an output brightness value of the display based on the first input grayscale value, wherein the first gamma correction controller comprises a voltage generator and a brightness controller, and wherein controlling the output brightness value of the display comprises:

generating, by the voltage generator, a reference voltage based on an input grayscale value; and controlling, by the brightness controller, based on the reference voltage, the display to display brightness with the output grayscale value.

2. The method according to claim 1, wherein the display comprises a Mura region, a brightness value of each pixel on the display at an initial brightness adjustment level is a second brightness value, and the method further comprises:

before determining the first brightness value of the display:

determining, based on the gamma correction lookup table, a second input grayscale value corresponding to the second brightness value;

performing demura on the Mura region of the display; and controlling an output brightness value of each pixel on the display based on the second input grayscale value.

3. The method according to claim 1, wherein the gamma correction lookup table comprises at least one of a plurality of discrete grayscale values and a plurality of brightness values, wherein a quantity of grayscale values is equal to a quantity of the brightness values, the grayscale values have a one-to-one correspondence to the brightness values, and the quantity of the discrete grayscale values is less than or equal to a total quantity of grayscale values of the display.

4. The method according to claim 1, wherein a current brightness value of the display at the current brightness adjustment level and a previous brightness value of the display at a previous brightness adjustment level satisfy a preset condition, wherein the current brightness value and the previous brightness value correspond to a same input grayscale value, and the preset condition is that a ratio of a difference between the current brightness value and the previous brightness value to the previous brightness value satisfies a Webber law.

5. The method according to claim 1, wherein a maximum brightness value supported by the display at the predetermined brightness adjustment level is greater than a maximum brightness value supported by the display at the current brightness adjustment level.

6. The method according to claim 1, wherein the predetermined brightness adjustment level is a maximum level supported when adjusting the brightness value.

7. The method according to claim 1, wherein determining the first input grayscale value corresponding to the first brightness value comprises:

obtaining, from the gamma correction lookup table, a brightness value closest to the first brightness value at the current brightness adjustment level when the first brightness value is not comprised in the gamma correction lookup table; and using a grayscale value corresponding to the obtained brightness value as the first input grayscale value corresponding to the first brightness value.

8. The method according to claim 1, wherein determining the first input grayscale value corresponding to the first brightness value specifically comprises:

determining, based on the gamma correction lookup table, two brightness values immediately adjacent to the first brightness value at the current brightness adjustment level when the first brightness value is not comprised in the gamma correction lookup table;

establishing a linear interpolation equation based on the two brightness values and grayscale values corresponding to the two brightness values; and obtaining, according to the linear interpolation equation and the first brightness value at the current brightness adjustment level, the first input grayscale value corresponding to the first brightness value.

9. An apparatus for controlling display brightness, comprising:

at least one processor, configured to determine a first brightness value of a display at a current brightness adjustment level;

a first gamma selector, configured to determine, based on a gamma correction lookup table, a first input grayscale value corresponding to the first brightness value, wherein the gamma correction lookup table comprises a gamma correction relationship between a brightness value of the display and an initial input grayscale value of the display at a predetermined brightness adjustment levels; and a first gamma correction controller, configured to control an output brightness value of the display based on the first input grayscale value, wherein the first gamma correction controller comprises:

a voltage generator, configured to generate a reference voltage based on the first input grayscale value; and a brightness controller, configured to control, based on the reference voltage, the display to display brightness with the output brightness value.

10. The apparatus according to claim 9, wherein the display comprises a Mura region, a brightness value of each pixel on the display at an initial brightness adjustment level is a second brightness value, the apparatus further comprises:

a Mura correction controller, configured to perform demura on the Mura region of the display before determining the first brightness value of the display;

a second gamma selector, configured to determine, based on the gamma correction lookup table, a second input grayscale value corresponding to the second brightness value before performing the demura on the Mura region of the display; and a second gamma correction controller, configured to control an output brightness value of each pixel on the display based on the second input grayscale value.

11. The apparatus according to claim 9, further comprising a memory, wherein the memory is configured to store the gamma correction lookup table.

12. The apparatus according to claim 9, wherein the gamma correction lookup table comprises at least one of a plurality of discrete grayscale values and a plurality of brightness values, wherein a quantity of grayscale values is equal to a quantity of the brightness values, the grayscale values have a one-to-one correspondence to the brightness values, and the quantity of the discrete grayscale values is less than or equal to a total quantity of grayscale values of the display.

13. The apparatus according to claim 9, wherein a current brightness value of the display at the current brightness adjustment level and a previous brightness value of the display at a previous brightness adjustment level satisfy a preset condition, wherein the current brightness value and the previous brightness value correspond to a same input grayscale value, and the preset condition is that a ratio of a difference between the current brightness value and the previous brightness value to the previous brightness value satisfies a Webber law.

14. The apparatus according to claim 9, wherein a maximum brightness value supported by the display at the predetermined brightness adjustment level is greater than a maximum brightness value supported by the display at the current brightness adjustment level.

15. The apparatus according to claim 9, wherein the first gamma selector is further configured to:

obtain, from the gamma correction lookup table, a brightness value closest to the first brightness value at the current brightness adjustment level when the first brightness value is not comprised in the gamma correction lookup table; and use a grayscale value corresponding to the obtained brightness value as the first input grayscale value corresponding to the first brightness value.

16. The apparatus according to claim 9, wherein the first gamma selector is further configured to:

determine, based on the gamma correction lookup table, two brightness values immediately adjacent to the first brightness value at the current brightness adjustment level when the first brightness value is not comprised in the gamma correction lookup table;

establish a linear interpolation equation based on the two brightness values and grayscale values corresponding to the two brightness values; and obtain, according to the linear interpolation equation and the first brightness value at the current brightness adjustment level, the first input grayscale value corresponding to the first brightness value.

17. A terminal device, wherein the terminal device comprises at least one processor, a first gamma selector, a first gamma correction controller, and a display, wherein the processor is configured to determine a first brightness value of the display at a current brightness adjustment level;

the first gamma selector is configured to determine, based on a gamma correction lookup table, a first input grayscale value corresponding to the first brightness value, wherein the gamma correction lookup table comprises a gamma correction relationship between a brightness value of the display and an initial input grayscale value of the display at a predetermined brightness adjustment levels; and the first gamma correction controller is configured to control an output brightness value of the display based on the first input grayscale value, wherein the first gamma correction controller comprises a voltage generator and a brightness controller, wherein the voltage generator is configured to generate a reference voltage based on an input grayscale value, and wherein the brightness controller is configured to control, based on the reference voltage, the display to display brightness with a brightness value corresponding to the input grayscale value.

18. The terminal device according to claim 17, wherein the display comprises a Mura region, a brightness value of each pixel on the display at an initial brightness adjustment level is a second brightness value, and the terminal device further comprises a Mura correction controller, a second gamma selector and a second gamma correction controller, wherein the Mura correction controller is configured to perform demura on the Mura region of the display before determining the first brightness value of the display;

the second gamma selector is configured to determine, based on the gamma correction lookup table, a second input grayscale value corresponding to the second brightness value before performing the demura on the Mura region of the display; and the second gamma correction controller is configured to control an output brightness value of each pixel on the display based on the second input grayscale value.

19. The terminal device according to claim 17, wherein the gamma correction lookup table comprises at least one of a plurality of discrete grayscale values and a plurality of brightness values, wherein a quantity of grayscale values is equal to a quantity of the brightness values, the grayscale values have a one-to-one correspondence to the brightness values, and the quantity of the discrete grayscale values is less than or equal to a total quantity of grayscale values of the display.

20. The terminal device according to claim 17, wherein a maximum brightness value supported by the display at the predetermined brightness adjustment level is greater than a maximum brightness value supported by the display at the current brightness adjustment level.

* * * * *